US012571298B2

(12) United States Patent
Omar et al.

(10) Patent No.: US 12,571,298 B2
(45) Date of Patent: Mar. 10, 2026

(54) INVERSION-BASED COMBINED COLLOCATED (TIME-DOMAIN) AND MULTI-FREQUENCY NON-COLLOCATED SENSOR DATA PROCESSING FOR EVALUATING CASINGS

(71) Applicant: Schlumberger Technology Corporation, Sugar Land, TX (US)

(72) Inventors: Saad Omar, Somerville, MA (US); Dzevat Omeragic, Lexington, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 277 days.

(21) Appl. No.: 18/557,088

(22) PCT Filed: Apr. 26, 2022

(86) PCT No.: PCT/US2022/026361

§ 371 (c)(1),
(2) Date: Oct. 25, 2023

(87) PCT Pub. No.: WO2022/232153

PCT Pub. Date: Nov. 3, 2022

(65) Prior Publication Data

US 2024/0240551 A1 Jul. 18, 2024

Related U.S. Application Data

(60) Provisional application No. 63/179,846, filed on Apr. 26, 2021.

(51) Int. Cl.
*E21B 47/007* (2012.01)
*E21B 47/13* (2012.01)

(52) U.S. Cl.
CPC ..... *E21B 47/007* (2020.05); *E21B 47/13* (2020.05)

(58) Field of Classification Search
USPC ..... 324/338
See application file for complete search history.

(56) References Cited

U.S. PATENT DOCUMENTS 7,960,969 B2 6/2011 Mouget
8,332,191 B2 12/2012 Rosthal
(Continued)

FOREIGN PATENT DOCUMENTS

WO 2016007267 A1 1/2016
WO 2020055493 A1 3/2020

OTHER PUBLICATIONS

Dennis, Jr. et al: "Numerical Methods for Unconstrained Optimization and Nonlinear Equations", SIAM Classics in Applied Mathematics, 1996, pp. 218-236.
(Continued)

*Primary Examiner* — Farhana A Hoque
(74) *Attorney, Agent, or Firm* — Jeffrey D. Frantz

(57) ABSTRACT

An inversion-based method has been developed to evaluate up to 5 or 6 nested casings by utilizing complementary sensitivities from time-domain collocated (relatively shallow) and multi-frequency, multi-spacing non-collocated (both relatively shallow and relatively deeper) pulsed eddy current measurements. Stand-alone inversion-based techniques are also disclosed to process time-domain collocated sensor measurements, which may come from single or multiple sensors of different lengths.

20 Claims, 13 Drawing Sheets

(56) References Cited

U.S. PATENT DOCUMENTS

| | | | | |
|---|---|---|---|---|
| 8,614,578 | B2 | 12/2013 | Gao | |
| 8,958,989 | B2 | 2/2015 | Legendre | |
| 9,715,034 | B2 | 7/2017 | Omeragic | |
| 9,977,144 | B2 | 5/2018 | David | |
| 10,082,593 | B2 | 9/2018 | Yu | |
| 2013/0193953 | A1 | 8/2013 | Yarbro | |
| 2015/0119601 | A1 | 4/2015 | Liao | |
| 2015/0338541 | A1 | 11/2015 | Nichols et al. | |
| 2016/0061776 | A1 | 3/2016 | Aslanyan | |
| 2017/0314387 | A1 | 11/2017 | Yang | |
| 2018/0074220 | A1 | 3/2018 | David | |
| 2018/0106763 | A1 | 4/2018 | Fouda | |
| 2018/0172872 | A1 | 6/2018 | Fouda | |
| 2019/0162870 | A1 | 5/2019 | San Martin | |
| 2019/0218904 | A1 | 7/2019 | Fouda | |
| 2020/0081148 | A1 | 3/2020 | Capoglu | |
| 2020/0271818 | A1 | 8/2020 | Fouda | |
| 2020/0400008 | A1 * | 12/2020 | Dutta | E21B 47/005 |

OTHER PUBLICATIONS

Nocedal et al., "Numerical Optimization", Second Edition, Springer Series in Operations Research, 2006, pp. 435-437.

Constable et al., Occam's inversion: A practical algorithm for generating smooth models from electromagnetic sounding data, Geophysics, vol. 52, No. 3, Mar. 1987, pp. 289-300.

Farquharson et al., "Non-linear inversion using general measures of data misfit and model structure", Geophys. J. Int., 1998, vol. 134, pp. 213-227.

Abubaker et al., " A three-dimensional parametric inversion algorithm for triaxial induction data", Jan. 2005, Geophysics, vol. 71, No. 1, pp. G1-G9.

Habashy et al., "A general framework for constraint minimization for the inversion of electromagnetic measurements", Progress in Electromagnetics Research, 46, 265-312, 2004.

Friedel, S., "Resolution, stability and efficiency of resistivity tomography estimated from a generalized inverse approach," Geophys. J. Int., 153, 305-316, 2003.

T.M. Brill, et al., "Electromagnetic casing Inspection tool for corrosion evaluation", International Petroleum Technology Conference, Feb. 2012.

Wu et al., "Influence of Steel Casing on Electromagnetic Signals," Geophysics, vol. 59, No. 3, Mar. 1994, pp. 378-390.

International Search Report and Written Opinion issued in the PCT Application PCT/US2022/026361, dated Aug. 9, 2022 (10 pages).

International Preliminary Report on Patentability issued in the PCT Application No. PCT/US2022/026361 dated Nov. 9, 2023, 7 pages.

* cited by examiner

INVERSION-BASED COMBINED COLLOCATED (TIME-DOMAIN) AND MULTI-FREQUENCY NON-COLLOCATED SENSOR DATA PROCESSING FOR EVALUATING CASINGS

CROSS-REFERENCE TO RELATED APPLICATION

This application is a National Stage of International Application No. PCT/US2022/026361, filed Apr. 26, 2022, which claims priority to and the benefit of U.S. Provisional Patent Application Ser. No. 63/179,846, entitled "Inversion-Based Combined Collocated (Time-Domain) and Multi-frequency Non-Collocated Sensor Data Processing for Evaluating up to Five Nested Casing," filed Apr. 26, 2021, which are hereby incorporated by reference in their entirety for all purposes.

FIELD OF THE INVENTION

Aspects of the disclosure relate to systems and methods for pulsed eddy current (PEC) based multi-casing corrosion evaluation. More specifically, aspects of the disclosure provide for inversion-based methods using combined collocated and non-collocated sensor data for evaluating up to five or six nested casings.

BACKGROUND INFORMATION

Well integrity evaluations, such as well casing integrity evaluations, provide vital information for natural resources (e.g., oil, gas, or water) production and various aspects (e.g., safety, environment, or cost) related to the production. Well casing integrity may be referred to as maintaining full control of well casings (e.g., pipes or tubes) within a well at all times, in order to prevent unintended fluid movement or loss of containment to the environment in drilling and well operations. Well casing defects may cause casing strength degradation, casing deformation, well suspension, and even well abandonment. However, complexities inside and surrounding the well in different environments may create challenges for accurately mapping various casing defects (e.g., casing thickness variations due to wear or corrosion) in a vicinity of the well.

With some exceptions (e.g., attenuated total reflection infrared (ATR-IR) spectroscopy), the majority of methods or processes used in casing integrity evaluations include determinations of the presence of one or more dissolved gases in a liquid (e.g., liquid sample taken from a well). Such determinations include degassing the liquid sample and analyzing the degassed gas phase. However, degassing may not be an assured measurement process because the amount of gas in the liquid may be unknown. Additionally, the degassing may include obtaining phase volumetric measurements that are related to the degassed gas phase.

SUMMARY

A summary of certain embodiments described herein is set forth below. It should be understood that these aspects are presented merely to provide the reader with a brief summary of these certain embodiments and that these aspects are not intended to limit the scope of this disclosure.

In one non-limiting embodiment, a method for determining well casing integrity may include exciting a cased hole configuration comprising a plurality of casings with a first electromagnetic field generated by a source. The first electromagnetic field excites a first series of currents in the plurality of casings, the first series of currents decay with time, the decayed first series of currents excite a second electromagnetic field, and the second electromagnetic field excites a second series of currents in the plurality of casings. The method may also include acquiring signals with a plurality of receiving elements disposed in a vicinity of the source. The acquired signals correspond to the second series of currents. The method may further include generating collocated data acquired with one or more receiving element of the plurality of receiving elements. In addition, the method may include generating non-collocated data acquired with the plurality of receiving elements. The method may also include processing the collocated data and the non-collocated data. The method may further include deriving estimations of casing thickness associated with the plurality of casings based at least in part on the processed collocated data and the processed non-collocated data.

In another example embodiment, a method for determining well casing integrity may include exciting a cased hole configuration comprising a plurality of casings with a first electromagnetic field generated by a source. The first electromagnetic field excites a first series of currents in the plurality of casings, the first series of currents decay with time, the decayed first series of currents excite a second electromagnetic field, and the second electromagnetic field excites a second series of currents in the plurality of casings. The method may also include acquiring signals with one or more receiving elements disposed in a vicinity of the source. The acquired signals correspond to the second series of currents. The method may further include generating collocated data based at least in part on the acquired signals with the one or more receiving elements. In addition, the method may include processing the collocated data. The method may also include deriving estimations of casing thickness associated with the plurality of casings based at least in part on the processed collocated data.

In yet another example embodiment, a system includes a downhole electromagnetic tool that includes one or more electromagnetic sources to generate a first series of electrical currents in a plurality of tubulars disposed in a vicinity of the one or more electromagnetic sources. The downhole electromagnetic tool also includes one or more receivers to measure individual or cumulative thicknesses of the tubulars based at least in part on a second series of electrical currents generated by an electromagnetic field excited by the first series of electrical currents being decayed with time. The downhole electromagnetic tool also includes processing circuitry to process measured individual or cumulative thicknesses of the tubulars.

BRIEF DESCRIPTION OF THE DRAWINGS

Various aspects of this disclosure may be better understood upon reading the following detailed description and upon reference to the drawings, in which.

DETAILED DESCRIPTION

Figure 1:
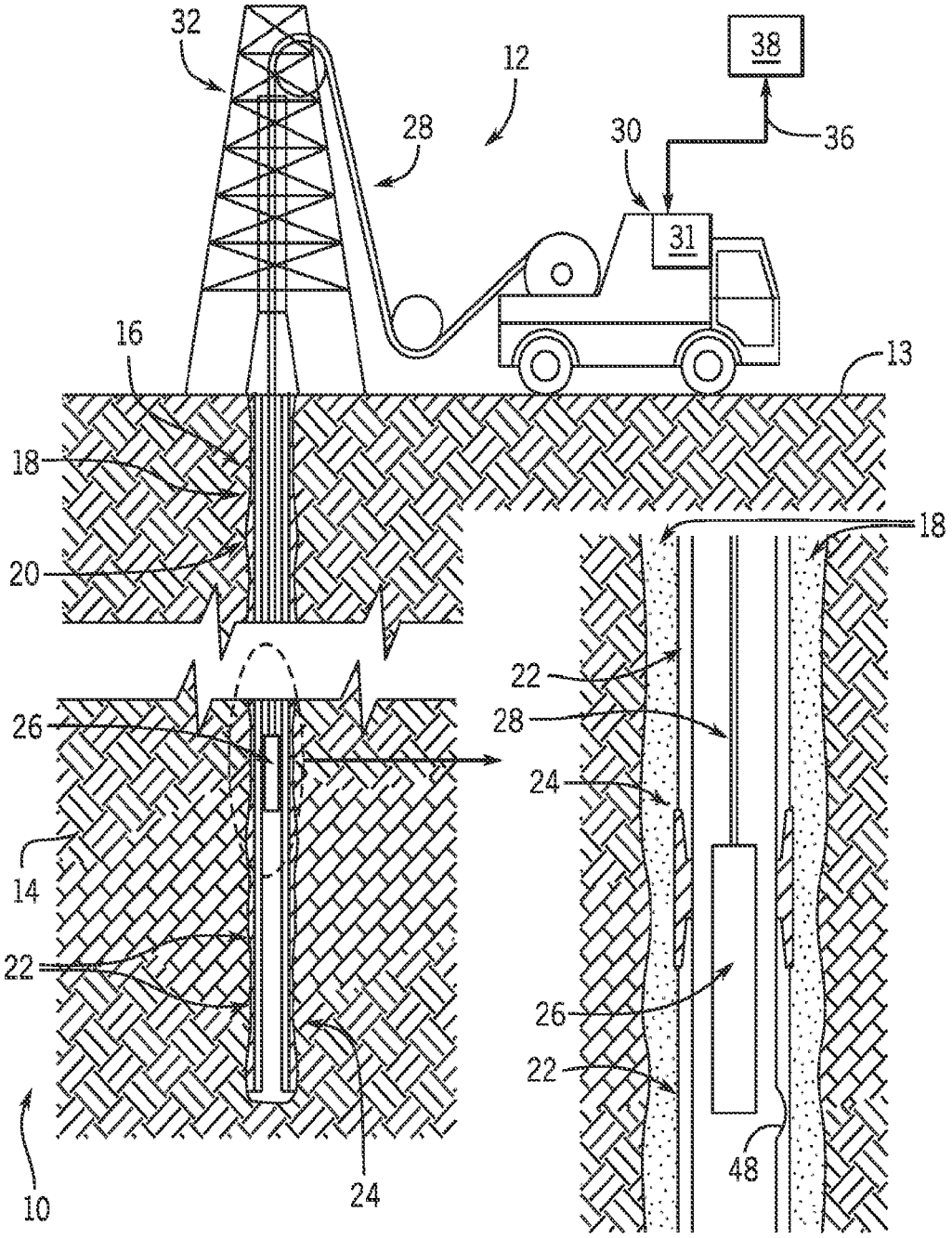
FIG. 1 depicts a schematic diagram of a system for measuring tubular thickness using a downhole electromagnetic (EM) logging tool, in accordance with embodiments of the present disclosure.

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first", "second" and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

In addition, as used herein, the terms "real time", "real-time", or "substantially real time" may be used interchangeably and are intended to describe operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "continuous", "continuously", or "continually" are intended to describe operations that are performed without any significant interruption. For example, as used herein, control commands may be transmitted to certain equipment every five minutes, every minute, every 30 seconds, every 15 seconds, every 10 seconds, every 5 seconds, or even more often, such that operating parameters of the equipment may be adjusted without any significant interruption to the closed-loop control of the equipment. In addition, as used herein, the terms "automatic", "automated", "autonomous", and so forth, are intended to describe operations that are performed are caused to be performed, for example, by a computing system (i.e., solely by the computing system, without human intervention). Indeed, it will be appreciated that the data processing system described herein may be configured to perform any and all of the data processing functions described herein automatically.

In addition, as used herein, the term "substantially similar" may be used to describe values that are different by only a relatively small degree relative to each other. For example, two values that are substantially similar may be values that are within 10% of each other, within 5% of each other, within 3% of each other, within 2% of each other, within 1% of each other, or even within a smaller threshold range, such as within 0.5% of each other or within 0.1% of each other.

Similarly, as used herein, the term "substantially parallel" may be used to define downhole tools, formation layers, and so forth, that have longitudinal axes that are parallel with each other, only deviating from true parallel by a few degrees of each other. For example, a downhole tool that is substantially parallel with a formation layer may be a downhole tool that traverses the formation layer parallel to a boundary of the formation layer, only deviating from true parallel relative to the boundary of the formation layer by less than 5 degrees, less than 3 degrees, less than 2 degrees, less than 1 degree, or even less.

Casing integrity is an important category of well integrity in drilling and well operations. Casing defects, such as casing thickness variations due to wear or corrosion, may cause casing strength degradation, casing deformation, well suspension, and even well abandonment. Casing wear and casing corrosion are some of the major concerns throughout a lifecycle of a well. Specific mitigation processes may be used to reduce risks caused by the casing wear or corrosion, such as casing material selection, production rate control, corrosion inhibitor treatment, and well monitoring. For instance, via the well monitoring, the casing thickness may be evaluated.

A variety of methods or processes have been developed for casing integrity evaluations (including casing thickness evaluations). Such methods or processes, with some exceptions (e.g., attenuated total reflection infrared (ATR-IR) spectroscopy), include determinations of the presence of one or more dissolved gases in a liquid (e.g., liquid sample taken from a well). A process of degassing, including degassing the liquid sample and analyzing the degassed gas phase, is often used in such methods or processes. However, the degassing may not be an assured measurement process because the amount of gas in the liquid sample may be unknown. Moreover, the degassing may include obtaining phase volumetric measurements that are related to the degassed gas phase.

Alternatively, methods based on well logging technologies may be used for casing integrity evaluations. For instance, in some methods via well logging based on electromagnetic (EM) technology, an EM logging tool is inserted into an interior diameter of a casing joint ("casing") or other conductive tubular. A transmitter of the EM logging tool creates an EM field that interacts with the casing and varies depending on a wall or casing thickness (hereafter simply "thickness") of the tubular. One or more receivers of the EM logging tool may be used to measure and generate a data log illustrating variations (e.g., thickness variations) in one or more resulting and returning EM fields. For instance, multiple receivers may be positioned at various axial distances (e.g., denoted as "d", where values of "d" is equal to zero representing collocated EM sensor(s), or greater than zero representing non-collocated sensors) from the transmitter such that the multiple receivers may measure the returning EM fields and generate collocated (time domain) and non-collocated (multi-frequency) data. The thickness of the tubular may be determined by analyzing the detected variations in the data log. An area of the tubular that is determined to have less thickness may indicate a defect in the tubular (e.g., due to corrosion). However, complexities, such as a physical design of the EM logging tool, may cause the defect to appear more than once (as a "ghost") on the data log. Such ghost events create new challenges for the casing integrity evaluations.

The present disclosure relates to an inversion-based method for evaluating up to 5 or 6 casings by utilizing complementary sensitivities from time-domain collocated (shallow) and multi-frequency, multi-spacing non-collocated (both shallow and deeper) pulsed eddy current measurements. Stand-alone inversion-based methods are also disclosed to process time-domain collocated sensor measurements, which may come from single or multiple sensors of different lengths.

For example, the disclosed methods may include inversion-based measurement calibration of raw time-domain measurements to determine individual pipe effective permeability and/or conductivity, and calibration shifts for all the measurement channels. The calibration may be done over multiple log sections or on a single clean and representative section of data showing minimal perturbation. The methods may include running robust median-based filtering and normalization of the time-domain data to get relative signal difference (e.g., voltage difference). The methods may also include generating a heat map from the normalized data to give qualitative time-to-depth visualization. Additionally, the methods may include collar identification of normalized time cumulative responses. Furthermore, the methods may include determining individual casing thickness by inverting time-domain measurements from single or multiple collocated sensors using, for example, Gauss-Newton parametric inversion.

The methods may include other techniques, such as determining individual casing thickness for up to 5- and 6-casings by inverting multi-frequency, multi-spacing non-collocated measurements using Gauss-Newton parametric inversion and time-domain processing results as initial guess; casing/tool eccentric flags from non-collocated sensors based on misfit from short spacing and visual display of possible eccentrics from collocated sensors based on metal gain indication in pipe-sections; inverting for inner and outer diameters by combining electromagnetic (EM) data (from an imaging tool) with other data such as ultrasonic or flux leakage measurements to constrain the problem with info about the first or second casing inner diameter or first casing outer diameter or eccentric; determining the data fit QC plotted as a mismatch while inverting, uncertainty in casing thicknesses, using the model covariance matrix from the inversion; evaluating eccentric casing using the 3D models (e.g., tabulated responses), or in combination with ultrasonic interpretation assume eccentric; approximating tool details and sensor interactions with the casings (e.g., using attenuations of multi-frequency measurements in the interpretation, and so forth.

By way of introduction, FIG. 1 depicts a schematic diagram of a system 10 for measuring tubular thickness using a downhole electromagnetic EM logging tool 26 according to one or more aspects of the present disclosure. Surface equipment 12 is located on a wellsite surface 13 above a geological formation 14 into which a wellbore 16 extends from the wellsite surface 13. An annular fill 18 has been used to seal an annulus 20 between the wellbore 16 and tubulars (e.g., casings) 22, such as via cementing operations. The EM logging tool 26 may be centered or decentered, such that a measuring and/or detecting device (e.g., a transmitter or a receiver) of the EM logging tool 26 is positioned centrally or off-center relative to a central longitudinal axis of the tubulars 22.

The tubulars 22 may be coupled together by collars 24. The tubulars 22 represent lengths of pipe including threads and/or other means for connecting each end to threads and/or other connection means of an adjacent collar 24 and/or tubular 22. Each tubular 22 and/or collar 24 may be made of steel and/or other electrically conductive materials able to withstand a variety of forces, such as collapse, burst, and tensile failure, as well as chemically-aggressive fluid. Each tubular 22 and/or collar 24 may have magnetic properties and be affected by an alternating EM current.

Figure 3:
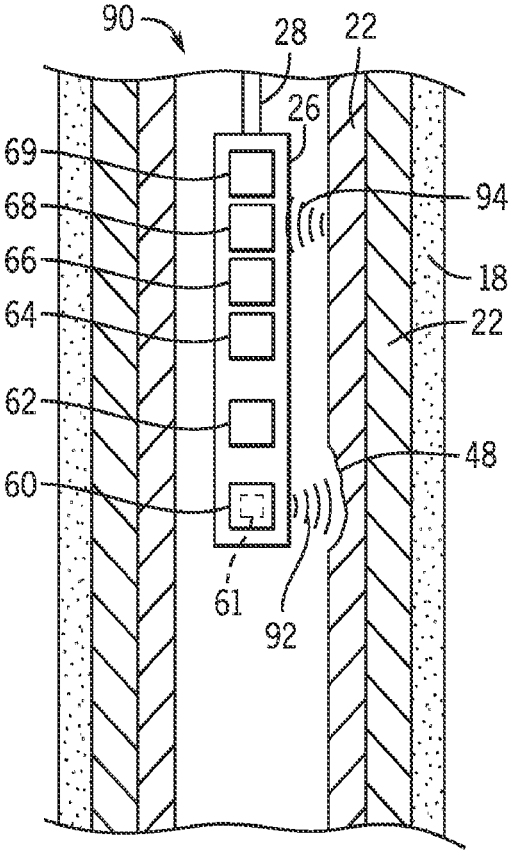
FIG. 3 depicts a schematic diagram of an example implementation of the EM logging tool shown in FIG. 2, in accordance with embodiments of the present disclosure.
Figure 4:
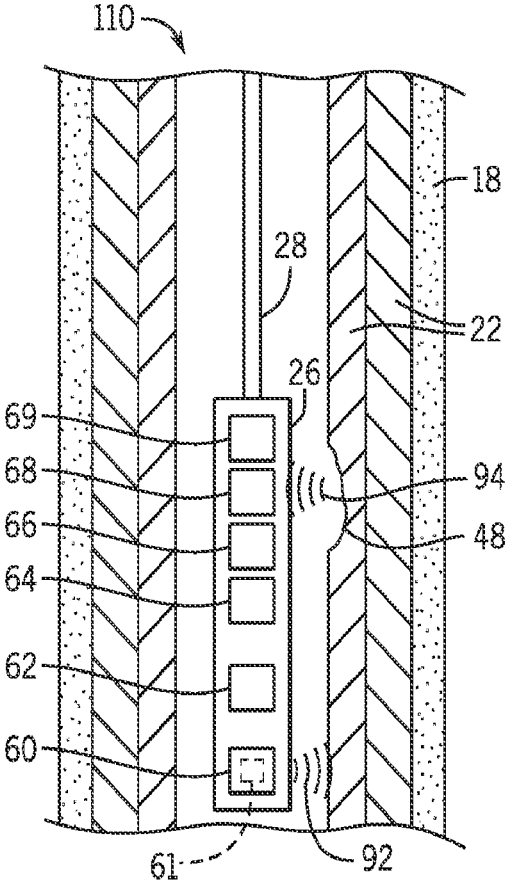
FIG. 4 depicts a schematic diagram of another example implementation of the EM logging tool shown in FIG. 2, in accordance with embodiments of the present disclosure.

The surface equipment 12 may carry out various well-logging operations to detect conditions (e.g., thicknesses) of the tubulars 22, including implementations in which the tubulars 22 are concentrically nested, as shown in FIGS. 3 and 4. The well-logging operations may measure individual and/or cumulative thicknesses of the tubulars 22 by using the EM logging tool 26.

The EM logging tool 26 may be conveyed within the wellbore 16 by a cable 28. Such cable 28 may include one or more mechanical cables, electrical cables, and/or electro-optical cables that include one or more fiber-optic lines protected against the harsh environment of the wellbore 16. In certain embodiments, the EM logging tool 26 may be conveyed using other conveyance means, such as coiled tubing or a tractor.

The EM logging tool 26 may generate a time-varying magnetic field signal that interacts with the tubulars 22. The EM logging tool 26 may be energized from the surface (e.g., via the cable 28) or have its own internal power used to emit the time-varying magnetic field signal via one or more EM sources (e.g., transmitters). The time-varying magnetic field signal may travel outward from the EM logging tool 26 through and along the tubulars 22. The time-varying magnetic field signal may generate eddy currents in the tubulars 22, which produce corresponding returning magnetic field signals measured as magnetic field anomalies by one or more receivers (e.g., sensors) in the EM logging tool 26. Each measurement may be denoted as a remote field eddy current (RFEC) if a source-receiver spacing is substantially longer (e.g., longer than approximately 2.5 times an outer diameter of the tubular 22 being inspected). At a defect 48 in the tubulars 22, such as the defect caused by metal gain or loss to the tubulars 22, the returning magnetic field signals may arrive at the EM logging tool 26 with a change in phase and/or signal strength (e.g., amplitude) induced by the defect 48, relative to other returning magnetic field signals not interacting with (e.g., passing through) the defect 48. In some cases, combined measurements (e.g., at far-field with RFEC, near-field, or transition zone) of multiple receivers may be used to create a data log and determine individual and/or cumulative thicknesses of the tubulars 22 using EM and/or other suitable field-testing analyses.

The EM logging tool 26 may be deployed inside the wellbore 16 by the surface equipment 12, which may include a vehicle 30 and a deploying system such as a drilling rig, workover rig, platform, derrick, and/or other surface structure 32. Data (e.g., log data) related to the tubulars 22 gathered by the EM logging tool 26 may be transmitted to the surface and/or stored in the EM logging tool 26 for later processing and analysis. The vehicle 30 may be fitted with and/or communicate with a data processing system 38 via a communication component 31 to perform data collection and analysis. When the EM logging tool 26 provides measurements to the surface equipment 12 (e.g., through the cable 28), the surface equipment 12 may pass the measurements as EM tubular evaluation data 36 to a data processing system 38.

The data processing system 38 may obtain the measurements from the EM logging tool 26 as raw data. In certain embodiments, the measurements may be processed or pre-processed by the EM logging tool 26 before being sent to the data processing system 38. Processing of the measurements may incorporate using and/or obtaining other measurements, such as from ultrasonic, caliper, and/or other EM logging techniques to better constrain unknown parameters of the tubulars 22. Accordingly, the data processing system 38 and/or the EM logging tool 26 may be utilized in acquiring additional information about the tubulars 22 and/or the wellbore 16, such as a number of tubulars 22, nominal thickness of each tubular 22, centering of the tubulars 22 relative to the wellbore 16, centering of the EM logging tool 26 within the wellbore 16, electromagnetic and/or ultrasonic properties of the tubulars 22, ambient and/or wellbore temperature, caliper measurements, and/or other parameters that may be utilized during thickness analyses of the tubulars 22.

Figure 2:
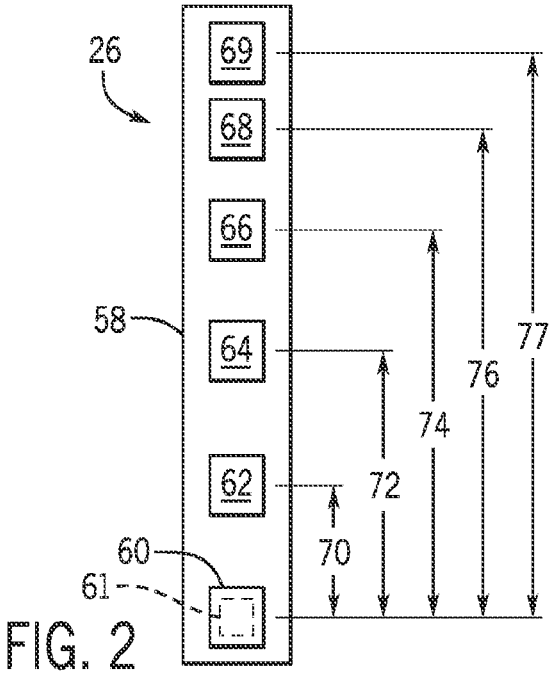
FIG. 2 depicts a schematic diagram of at least a portion of an example implementation of an EM logging tool, in accordance with embodiments of the present disclosure.

FIG. 2 depicts a schematic diagram of at least a portion of an example implementation of the EM logging tool 26 that may be utilized for casing and other tubular inspection within the scope of the present disclosure. The EM logging tool 26 may include a transmitter 60, one or more collocated receivers 61, and one or more non-collocated receivers (e.g., receivers 62, 64, 66, 68, and 69). The transmitter 60, the one or more collocated receivers 61, and the one or more non-collocated receivers 62, 64, 66, 68, 69 may be enclosed within or otherwise carried with a housing 58. The housing 58 may be a pressure-resistant housing.

The receivers 62, 64, 66, 68, and 69 may be operated based on various magnetic field detection techniques, such as coiled-winding, Hall-effect sensor, giant magneto-resistive sensor, and/or other magnetic field measuring means. The receivers 62, 64, 66, 68, and 69 may be axially aligned within the EM logging tool 26, as depicted in the example implementation shown in FIG. 2. In certain embodiments, or one or more of the receivers 62, 64, 66, 68, and 69 may be radially or transversely offset along an axis (e.g., longitudinal axis) of the EM logging tool 26. For example, the one or more of the receivers 62, 64, 66, 68, and 69 may be azimuthally offset towards or adjacent a perimeter of the EM logging tool 26. In such embodiments, multiple receivers distributed azimuthally may permit generating a two-dimensional image of properties (e.g., thickness) of the tubulars 22. Embodiments within the scope of the present disclosure may also include implementations using multiple transmitters, in which windings of the multiple transmitters are transverse or oblique, as in a saddle coil arrangement, which couple to the receivers or additional receiver windings.

In the example implementation shown in FIG. 2, the one or more collocated receivers 61 are located at the same location as the transmitter 60 (at zero distance from the transmitter 60), and the receivers 62, 64, 66, 68, and 69 are located at different distances away from the transmitter 60. For example, the receiver 62 may be located a distance 70 from the transmitter 60, the receiver 64 may be located a distance 72 from the transmitter 60, the receiver 66 may be located a distance 74 from the transmitter 60, the receiver 68 may located a distance 76 from the transmitter 60, and the receiver 69 may located a distance 77 from the transmitter 60. The distances 72, 74, 76, and 77 may each be a multiple of the distance 70. For example, the distance 72 may be twice the distance 70. In certain embodiments, the receivers 62, 64, 66, 68, and 69 may be located at distances of between 0 inches to 120 inches or more from the transmitter 60.

The receivers 62, 64, 66, 68, and 69 may detect a strength (e.g., signal amplitude) and/or a phase of the returning magnetic field from the tubulars 22. The EM logging tool 26 and/or the data processing system 38 may use detected values (e.g., amplitude and/or phase values) to create a data log. Based on the data log, the EM logging tool 26 and/or the data processing system 38 may determine individual and/or cumulative thicknesses of the tubulars 22 utilizing various EM and/or other suitable field-testing analyses. For example, by minimizing a norm of the difference (e.g., using a least-squares minimization) between the observed data (e.g., the data log) and synthetic data (e.g., simulated data log from a numerical modeling), the EM logging tool 26 and/or the data processing system 38 may determine best-fit parameters for a model (e.g., a digital representation) of the tubulars 22. Various techniques, such as inversion, model searching, and simulated annealing may be used to interpret the data log.

FIG. 3 depicts a schematic diagram of an example implementation of the EM logging tool 26 shown in FIG. 2. The example implementation includes a system 90 for measuring thickness of the tubulars 22. As the EM logging tool 26 descends through the tubulars 22, the transmitter 60 generates a time-varying magnetic field 92 that interacts with the tubulars 22 made by certain conductive materials. The time-varying magnetic field 92 travels outward from the transmitter 60 and then through and along the tubulars 22. The time-varying magnetic field 92 generates eddy currents in the tubulars 22, which produce corresponding returning magnetic field 94. The returning magnetic field 94 propagates to the receivers 62, 64, 66, 68, and 69, which detect the returning magnetic field 94 and convert detected portions of the returning magnetic field 94 into corresponding signals. As the transmitter 60 passes by the defect 48, a portion of the returning magnetic field 94 may arrive at the receiver 68 with a shift of phase and/or a change in strength (e.g., signal amplitude) relative to when the transmitter 60 is not passing by the defect 48, as depicted in FIG. 4 below.

FIG. 4 depicts a schematic diagram of another example implementation of the EM logging tool 26 shown in FIG. 2. The example implementation includes a system 110 for measuring thickness of tubulars 22. As the EM logging tool 26 travels further downhole within the tubulars 22, the receiver 68 passes by the defect 48, as shown in FIG. 4. The returning magnetic field 94 may arrive at the receiver 68 with a different phase shift and/or change in strength (e.g., signal amplitude) relative to when the transmitter 60 is passing by the defect 48, as depicted in FIG. 3 above. Thus, the defect 48 may be detected twice (as a "ghost") by the combination of the transmitter 60 and the receiver 68, including a first time when the transmitter 60 passes by the defect 48, and a second time when the receiver 68 passes by the defect 48. In certain embodiments, different combinations, such as the transmitter 60 and one of the other receivers 62, 64, 66, and 69, may detect similar "ghosts" as the transmitters 60 and then the corresponding receiver passes by the defect 48, respectively. Such phenomenon (e.g., "ghost") may also be observed at the collars 24 due to their increase of metal thickness when coupled to the tubulars 22, and also at other completion components in a well.

In certain embodiments, the EM logging tool 26 may include one or more transmitter coils with one or more collocated receivers wrapped on top of transmitter and/or one or more non-collocated receiver subs. For instance, one receiver (e.g., receiver 68) may detect multiple returning magnetic fields (e.g., returning magnetic field 98) excited by time-variant (e.g., decayed) eddy currents in multiple casings of the tubulars 22 and generate a set of time-domain collocated data. In some embodiments, two or more receivers may be situated at the same location and detect one or more returning magnetic fields excited by the time-variant eddy currents in one or more casings of the multiple casings of the tubulars 22 and generate a second set of time-domain collocated data. In some embodiments, multiple receivers situated at different locations may detect different multiple returning magnetic fields (e.g., arriving at different receiver locations) excited by the time-variant eddy currents in the multiple casings of the tubulars 22 and generate a set of multi-frequency, multi-spacing non-collocated data. The quantity of the one or more non-collocated receiver subs may be any number, such as one, three, ten, or the like. The one or more non-collocated receiver subs may include any number of non-collocated receivers. For example, a first non-collocated receiver sub may include one receiver, a second non-collocated receiver sub may include two receivers, a third non-collocated receiver sub may include 3 receivers, and a fourth non-collocated receiver sub may include 4 receivers.

In certain embodiments, the transmitters 60 may be excited by a time-domain pulse excitation and a series of continuous wave (CW) multi-frequency excitations. The time-domain pulse excitation may facilitate collocated sensor acquisition during an off cycle or suffice to record non-collocated responses which may electronically be converted into multi-frequency (harmonics) measurements. In some cases, decreased signal-to-noise (S/N) ratios associated with certain frequencies (e.g., higher harmonics) due to an inverse scaling with frequency, may be addressed by the series of CW multi-frequency excitations where each frequency is excited individually to achieve higher (e.g., maximum) S/N ratio. A fundamental frequency of the EM logging tool 26 may be as low as 0.3 Hz that may penetrate as deep as 5 and 6 metallic casings.

In certain embodiments, a total metal loss may be evaluated from a look-up table of measured phase, where a receiver voltage is normalized to a signal from a monitor coil wound around the transmitter 60. The measurements and interpretations described above may be based on remote field eddy current (RFEC) principle, where the phase of an induced signal (e.g., the returning magnetic field 94) is proportional to total casing thickness if the receiver (e.g., receiver 68) is sufficiently far from the transmitter 60.

Some inversion-based methods may be capable of processing the multi-frequency and multi-spacing non-collocated measurements to quantify the individual casing thickness in cases like multiple strings including 2 or 3 nested casings. However, such methods may not be able to evaluate up to 4 and 5 nested casings using the methods and systems described in the present disclosure, such as acquiring and processing time-domain measurements from single or multiple collocated sensors, and acquiring and processing (e.g., using combined workflow) both collocated and non-collocated measurements. In certain embodiments, a Gauss-Newton model-based inversion may be used to evaluate multiple casing thicknesses from time-domain collocated sensors and further using the inverted results in processing deeper multi-frequency multi-spacing non-collocated measurements.

Pulsed eddy current (PEC) evaluation of multiple casings may include using pulsed current source to excite eddy currents in the casings. A primary electromagnetic (EM) field generated by a transmitter coil (e.g., solenoidal coil) may induce the eddy currents in the surrounding casings flowing azimuthally along a specific direction to generate a secondary EM field opposing the excitation field (the primary EM field). The secondary EM field may decay exponentially, therefore generating (e.g., inducing) currents in surrounding casings that are sensed by the receiver coil. In some embodiments, the receiver coil(s) of the one or more collocated receivers 61 may be wound on the same core as the transmitter coil. In some embodiments, the receiver coil(s) of the one or more collocated receivers 61 may be wound on a different core from the transmitter coil.

Figure 5:
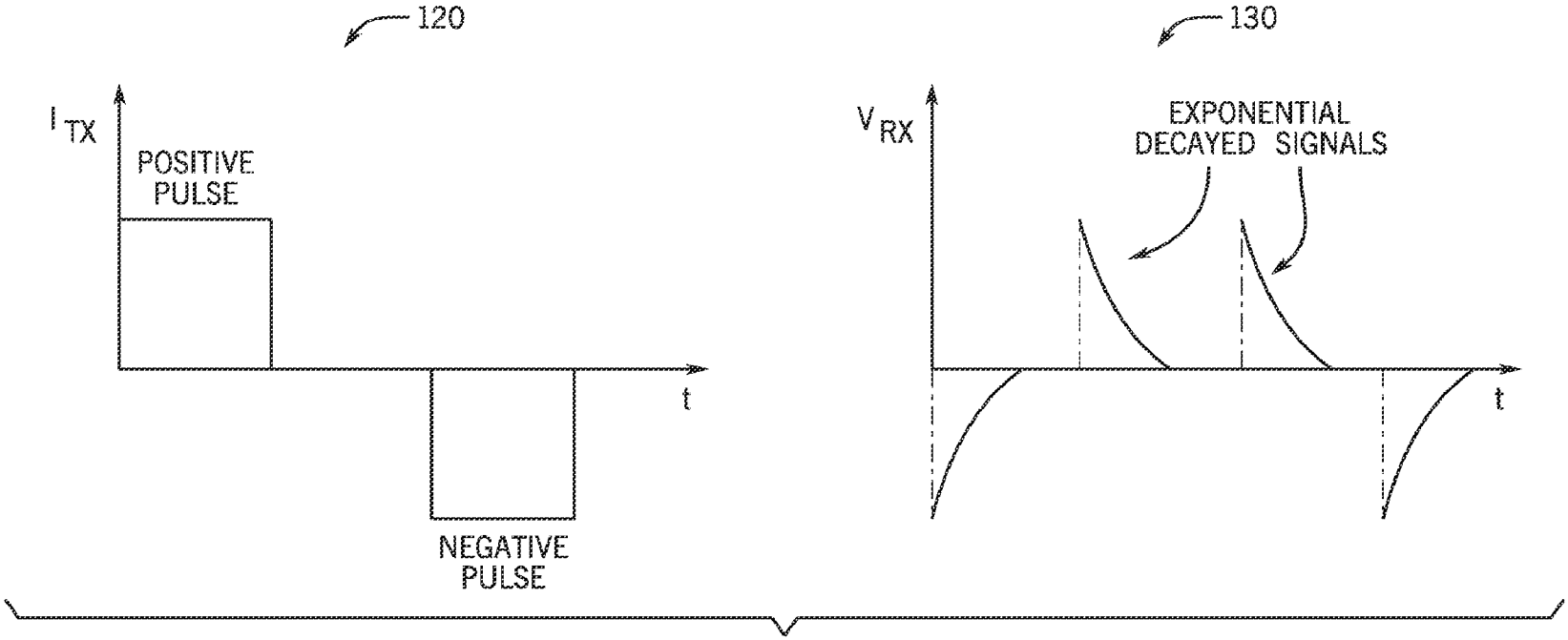
FIG. 5 depicts an example of pulsed current excitation including positive and negative pulses that may be used to inspect surrounding casings, in accordance with embodiments of the present disclosure.

With the foregoing in mid, FIG. 5 depicts an example of pulsed current excitation including positive and negative pulses that may be used to inspect surrounding casings. A graph 120 shows a time-varying current signal representing a pulsed eddy current $I_{TX(t)}$ (on the left) and a graph 130 shows a time-varying voltage signal representing an induced receiver voltage $V_{RX(t)}$ (on the right) that decays exponentially over time when it is induced by the pulsed eddy current. In certain embodiments, corresponding receiver responses (e.g., multiple voltage signals) may be stacked for improved signal-to-noise (S/N) ratio.

The time taken to induce current in a casing with parameters such as outer diameter (OD), thickness (Δ), permeability (μ), and conductivity (σ), is proportional to a diffusion constant (μ·σ), thickness squared ($\Delta^2$), as well as casing position. Currents in inner casings are induced earlier than in outer casings due to the geometrical proximity to the excitation. Therefore, in an axially symmetric multi-casing environment, the early-time responses may correspond to the first casing, intermediate-time responses may correspond to the inner two casings, and late-time responses may correspond to all casings. Time-associated responses from inner to outermost casings may form the basis of PEC multi-casing corrosion evaluation, in which early-time response variations are attributed to metal losses in inner casings and later-time response variations are attributed to metal losses in outer casings. Such a process is referred to as time-to-depth mapping throughout the present disclosure.

Figure 6:
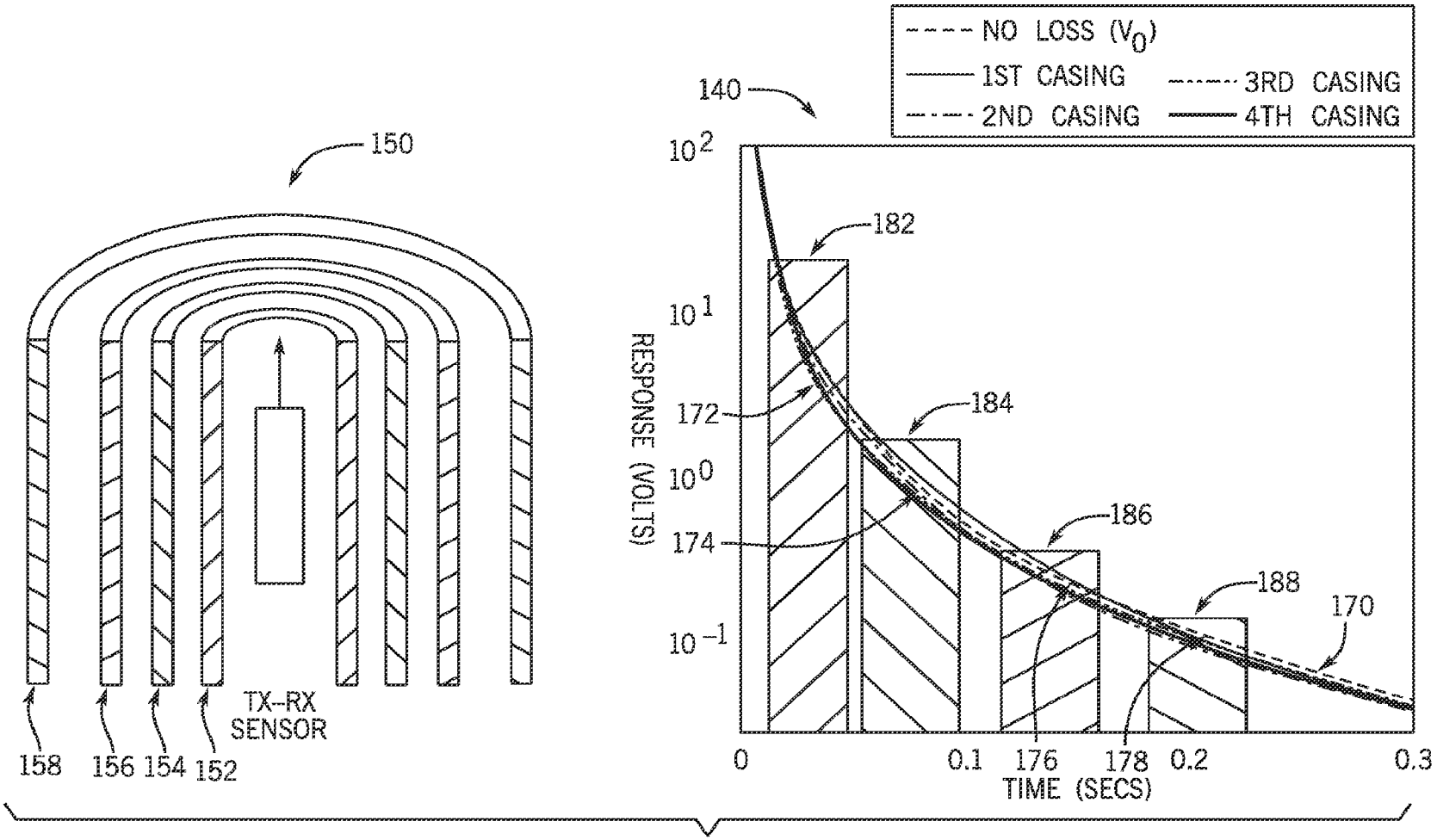
FIG. 6 depicts an example of PEC sensor response for four casings for 50% casing losses of individual strings, in accordance with embodiments of the present disclosure.

FIG. 6 depicts an example of PEC sensor response for four casings for 50% casing losses of individual strings. A sensor response vs. time plot 140 shows a simulated 12 inch collocated sensor responses from a casing assembly 150 that includes four concentric casings 152, 154, 156, and 158 with outer diameters (ODs) of 7 inches, 9⅝ inches, 13⅜ inches, and 18⅝ inches, respectively, and with nominal thicknesses ($\Delta_{nom}$) of 0.317 inches, 0.394 inches, 0.43 inches, and 0.435 inches, respectively. The response from nominal thickness casings (representing a case without loss of casing thickness) is shown as curve 170, whereas curves 172, 174, 176, and 178 represent responses when 50% of the first, second, third and fourth casing, respectively, is individually corroded. Corresponding rectangles 182, 184, 186, and 188 show time ranges in which the change in response is predominantly affected by individual casing variation and potentially may be used for corrosion analysis, typically by picking response from relevant time interval.

In some cases, casing corrosion responses may not be localized in time, but rather have influence on later times as well (e.g., changes in responses after 180 ms come from all four casings). Therefore, the casing corrosion responses may not be used to evaluate just the fourth-casing thickness. The casing corrosion response variations may be affected not only by the casing properties and dimensions (e.g., μ, σ, Δ, and OD) but also by the length of the defect. Factors described above may further complicate the multi-casing corrosion evaluations even in the cases such as concentric casing configurations.

As mentioned previously, the casing response from PEC may have an exponentially decaying nature. In certain embodiments, to better represent the change in the sensor responses from casing response variations, the measurement sensitivities (e.g., collocated PEC measurement sensitivities) may be analyzed by using relative voltage change/difference $\Delta v_r$ in measured signal voltage V from the nominal response in centered and non-corroded setting $V_{nom}$, given as:

$$\Delta v_r = \frac{V_{nom} - V}{V_{nom}}$$

Figure 7:
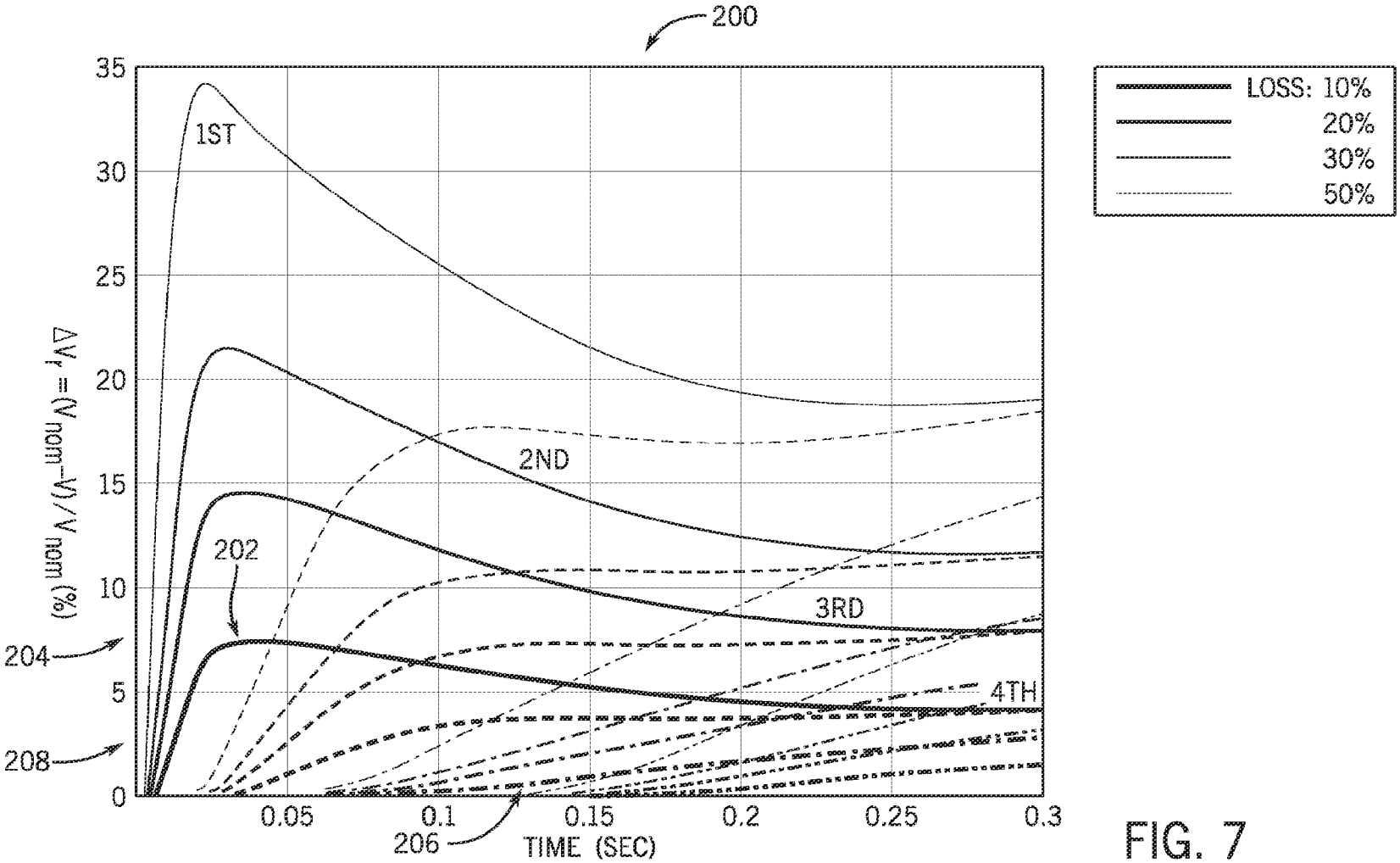
FIG. 7 depicts an example of measurement sensitivity of the PEC sensor response of FIG. 6 that represents four metal casing losses in steps of 10% to 50% of nominal thickness, in accordance with embodiments of the present disclosure.

FIG. 7 depicts an example of measurement sensitivity of the PEC sensor response of FIG. 6 that represents four metal casing losses in steps of 10% to 50% of nominal thickness. A relative voltage difference vs. time plot 200 shows the relative voltage change, $\Delta v_r$ for 12 inches sensor responses for four casings (with OD as 7 inches, 9⅝ inches, 13⅜ inches, and 18⅝ inches) when the casing losses (e.g., metal losses) are individually changed in steps of 10% of nominal thickness (with $\Delta_{nom}$ as 0.317 inches, 0.394 inches, 0.43 inches, and 0.435 inches) to 50%. The sensor responses from FIG. 6 are shown as relative voltage change $\Delta v_r$ curves 202 (with respect to axis 204 on a logarithmic scale) and 206 (with respect to axis 208 on a linear scale) in a semi-log plot (plot having two collocated axis 204 and 208 in different scales) in FIG. 7. As illustrated, the improved representation of sensitivity to outer casings (as shown in solid lines) is noticeable compared to apparently minuscule changes in the semi-log plot for raw sensor responses (as shown in dashed lines). However, the voltages are measured up to the noise floor, which is not apparent in the relative voltage change $\Delta v_r$ representation. Therefore, the relative voltage change $\Delta v_r$ representation for a sensor response may be used in conjunction with measurable signal strength.

In certain embodiments, the raw responses, $V_m$ (in volts), may be normalized using median filtered responses, $V_{med}$, given as:

$$V_m = \frac{\nabla - V_{med}}{V_{med}}$$

For a single pipe length of 40 ft. (resulting in "local drift"), an approximate three pipe lengths of 100 ft. (namely "global drift") may be used in a median filtering as median filter length. The length of the local median window may be automatically increased from 40 ft. to 60 ft. depending on the length of detected metal loss sections in a data log. The normalized response is primarily sensitive to changes in casing profiles and is, to the first order, insensitive to variation in casing conductivity and magnetic permeability. Certain filters, such as triangle windowed smoothing filter may be applied to certain channels to mimic change of vertical resolution at later times coming from outer casings.

The normalized responses may be used to create metal loss interpretation heat-maps as a function of time and measured depth.

An artifact of such median filtering may include filtering out corrosion for sections longer than half the filter length. Such long sections of pipe corrosion may be handled by correcting the raw responses $V_m$ using differences from $V_0=(V-V_{cal})/V_{cal}$, where $V_{cal}$ is the calibration zone response. Whenever Vc is greater than a threshold value (e.g., 0.2 volt) and difference between Vc and $V_m$ is more than the threshold value, the raw responses Vm may be replaced by a value (e.g., Vc−0.15). In cases such as the raw responses Vm is greater than 0.05 volt and the difference between Vm and Vc are greater than 0.025, the raw responses Vm may be replaced by a second value (e.g., Vc+0.025), which may happen at near collar locations.

In certain embodiments, collar identification may be done on the scaled and time averaged $V_m$ signal to aid in processing collar sections differently from non-collar sections. A collar identification algorithm may be used. In some cases, collocated sensor time domain data may be transformed for recycling the collar identification algorithm. The corresponding scaled sensor response, $A_{collar}$, may be generated by taking a mean over the time at each depth location using the following formula:

$$A_1(z) = \text{mean}(A_{drift}(t, z));$$

$$A_2 = A_1 + |\min(A_1)|;$$

$$A_{collar} = 2A_2/\max(A_2)$$

Figure 8:
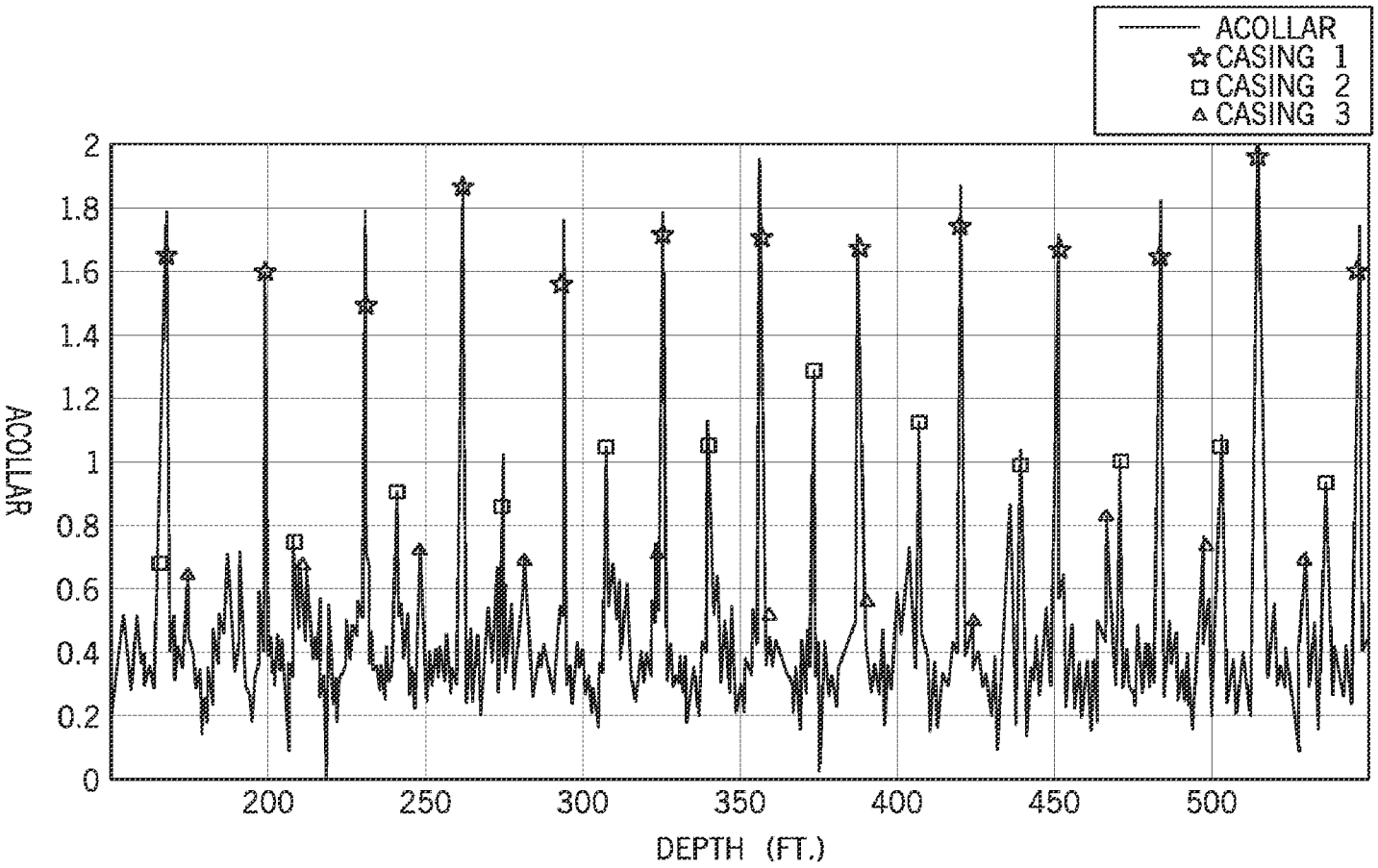
FIG. 8 depicts results of a collar identification algorithm for collocated sensor's scaled response, in accordance with embodiments of the present disclosure.

With the preceding in mind, FIG. 8 shows an example of results of a collar identification algorithm for scaled sensor response. Such results may be obtained by applying the collar identification algorithm on the scaled sensor response $A_{collar}$. The solid curves represent the scaled sensor response $A_{collar}$ for different casings (e.g., casing 1 represented by star symbol, casing 2 represented by square symbol, and casing 3 represented by triangle symbol).

In certain embodiments, an inversion-based workflow may be used for processing PEC collocated sensor data to evaluate multi-casing corrosions up to five or six nested casing thicknesses. In certain embodiments, synthetic data, such as simulated data associated with thousands of random casing thicknesses may be used to assess the inversion-based workflow.

Figure 9:
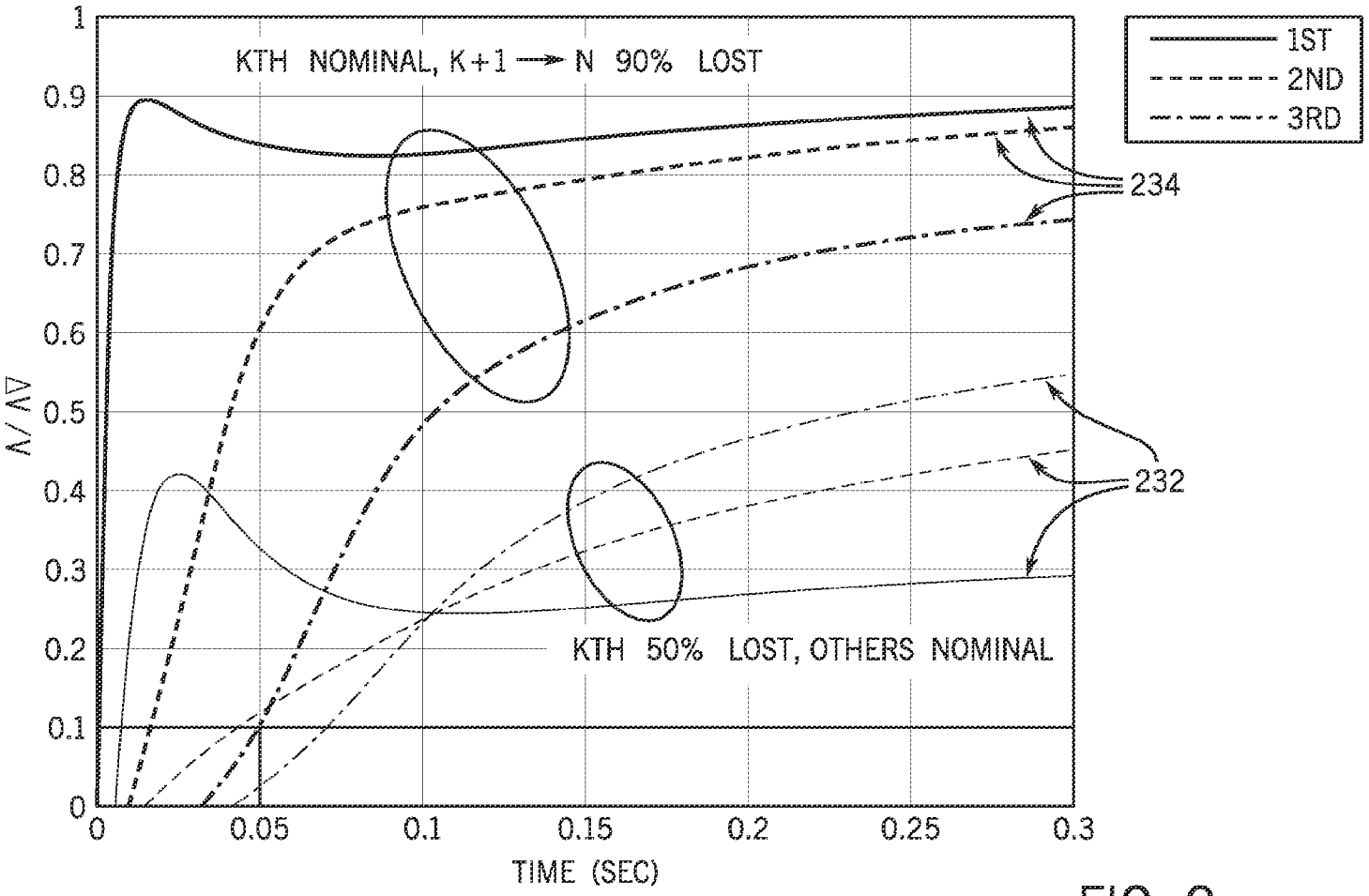
FIG. 9 depicts an example automatic adaptive window selection used in collocated sensor data processing, in accordance with embodiments of the present disclosure.

In certain embodiments, a robust automatic sensitivity-based time windowing may be used to generate initial guesses for each casing thickness. FIG. 9 depicts an example automatic adaptive window selection used in collocated sensor data processing. For example, in cases where outer casings are severely corroded, it may be difficult to use consecutive casing's 50% lossy 10% thresholds with other casings at nominal thickness, as shown in light lines 232 in FIG. 9. A more robust and consistently successful windowing selection was to pick a nominal thickness curve of each casing with all outer casings 90% corroded and using 10% dV/V (rising) times of corresponding nominal thickness curve and the same for the next outer casing to define the current casing's time window. The dark lines 234 represent selected plots for selection of windows shown as rectangles along the time axis in FIG. 9.

In cases of inverting casing thicknesses, N-dimensional (where N is the number of casings) forward modeling tables may be constructed using software tools, such as NGSolve TD solver for different metal losses (e.g., 5, 10, 20, 30, 50, 70 or 90%) as well as for different metal gains (e.g., 5, 10, 30 or 50%) for inverting casing collars (e.g., over three times the pipe outer diameter), using the calibrated conductivities and permeability (e.g., $\mu_r$=80). For non-collar sections, casing thicknesses may be inverted in a robust multi-pass (e.g., three-pass) multi-step workflow using time-windowed data for each casing. In the following examples, three sensors with different lengths may be used. In some instances, a sensor S may have a length of 5 inches or smaller, a sensor M may have a length of 12 inches or smaller, and a sensor D may have a length of 15 inches or longer.

In the first example of multiple collocated sensors, the three-pass multi-step workflow may include the following steps:

a. First casing thickness is inverted using sensor M (and sensor S, if available) $W_1$ (windowed first casing) data;
b. Second casing thickness is inverted using sensor M $W_2$ (windowed second casing) data;
c. Update sensor D windows, then invert third to fifth casing thicknesses using combined sensor M and sensor D $W_3$ (windowed third casing) and $W_4$ (windowed fourth casing) data;
d. Update sensor D windows, then invert third casing thicknesses using sensor D $W_3$ data;
e. Update sensor D windows, then invert fourth casing thicknesses using sensor D $W_4$ data;
f. Update sensor D windows, then invert fifth casing thicknesses using sensor D $W_5$ (windowed fifth casing) data; and
g. Update sensor M (and sensor S, if available) windows for next pass.

In the second example of a single sensor, the three-pass multi-step workflow may include the following steps:

a. First casing thickness is inverted using sensor M $W_1$ data;
b. Second casing thickness is inverted using sensor M $W_2$ data;
c. Update sensor M windows, then invert third to fifth casing thicknesses using $W_3$, $W_4$, and $W_5$ data, respectively;
d. Update sensor M windows, then invert third casing thicknesses using $W_3$ data;
e. Update sensor M windows, then invert fourth casing thicknesses using $W_4$ data;
f. Update sensor M windows, then invert fifth casing thicknesses using $W_5$ data; and
g. Update M sensor windows for next pass.

In cases where the collar sections are used (e.g., collar casings) in the multi-casing evaluations, inverted thicknesses of neighboring casings may be utilized to invert thicknesses of other casings.

In some cases, one may generate synthetic data to evaluate performance of the proposed methods, where four or five casings are used in the multi-casing evaluations, four hundreds or five hundred uniformly (e.g., 0, 1) distributed random numbers may be generated, respectively, such that the first 100 numbers are multiplied by first casing nominal thickness and assigned to the first casing, the next 100 numbers are assigned to the second casing after multiplication by second-casing nominal thickness, and so on. The 101st entry is taken as nominal thickness for all casings. This approach results in 101 simulated data points. The casing relative permeability and conductivity may be selected as 100 and 3.5 ms/m, respectively. All casings are assumed to be concentric with respect to a sensor axis (e.g., axis along which the sensor has longer dimension than the other axes). The sensor M (12 inches long) response is sampled logarithmically in time from 0.5 ms to 300 ms, resulting in 60 channels. Similarly, the sensor D (24 inches long) response is sampled logarithmically in time to 900 ms, resulting in 150 channels.

Figure 10:
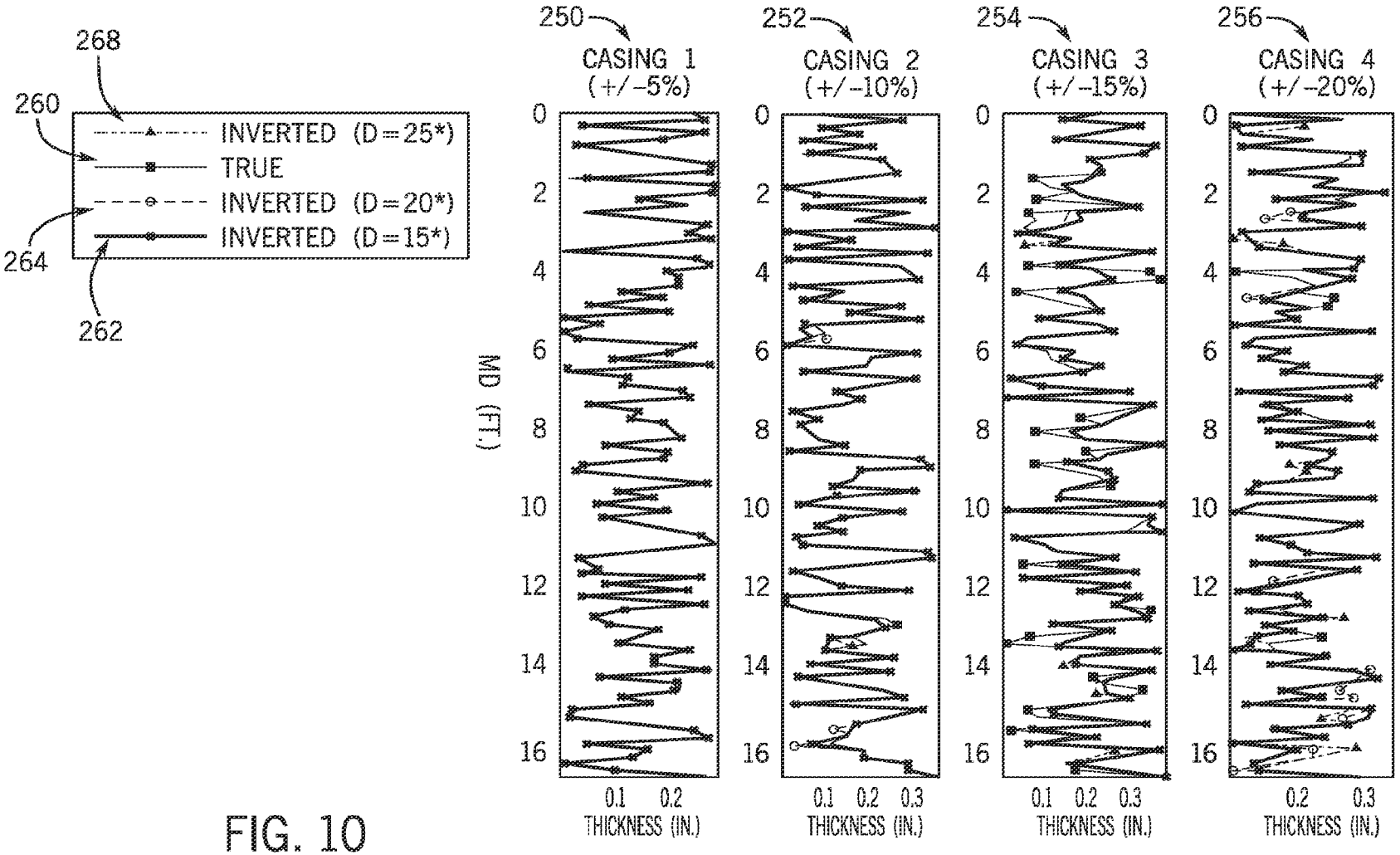
FIG. 10 depicts example processing results for four casings for collocated time-domain measurements, in accordance with embodiments of the present disclosure.

In a first example where four casings are used in the multi-casing evaluations, a four-casing processing is applied to the synthetic data described above. Corresponding four-casing processing results are presented in FIG. 10, which depicts example processing results for four casings 250, 252, 254, and 256 for collocated time-domain measurements corresponding to sensor M (12 inches long) and three different lengths (15, 20, and 25 inches) of sensor D. For different combinations of sensors M (12 inches long) and D (15 inches, 20 inches, and 25 inches long) used for collocated time-domain measurements, the example processing results primarily match with each other. For instance, inverted casing thickness curves 262, 264, 266, corresponding to sensor D length as 15, 20, and 25 inches, respectively, primarily match with a curve 260 corresponding to the sensor M and representing a true casing thickness for each casing. Such processing results based on synthetic data shows that robust and reliable first two casing results are obtained whereas the ambiguity in the third and fourth casings have certain levels of over- or under-estimations. For example, the estimations of losses in the fourth casing have a +/−20% error margin, whereas estimations of losses in the third casing have a smaller +/−15% error margin.

Figure 11:
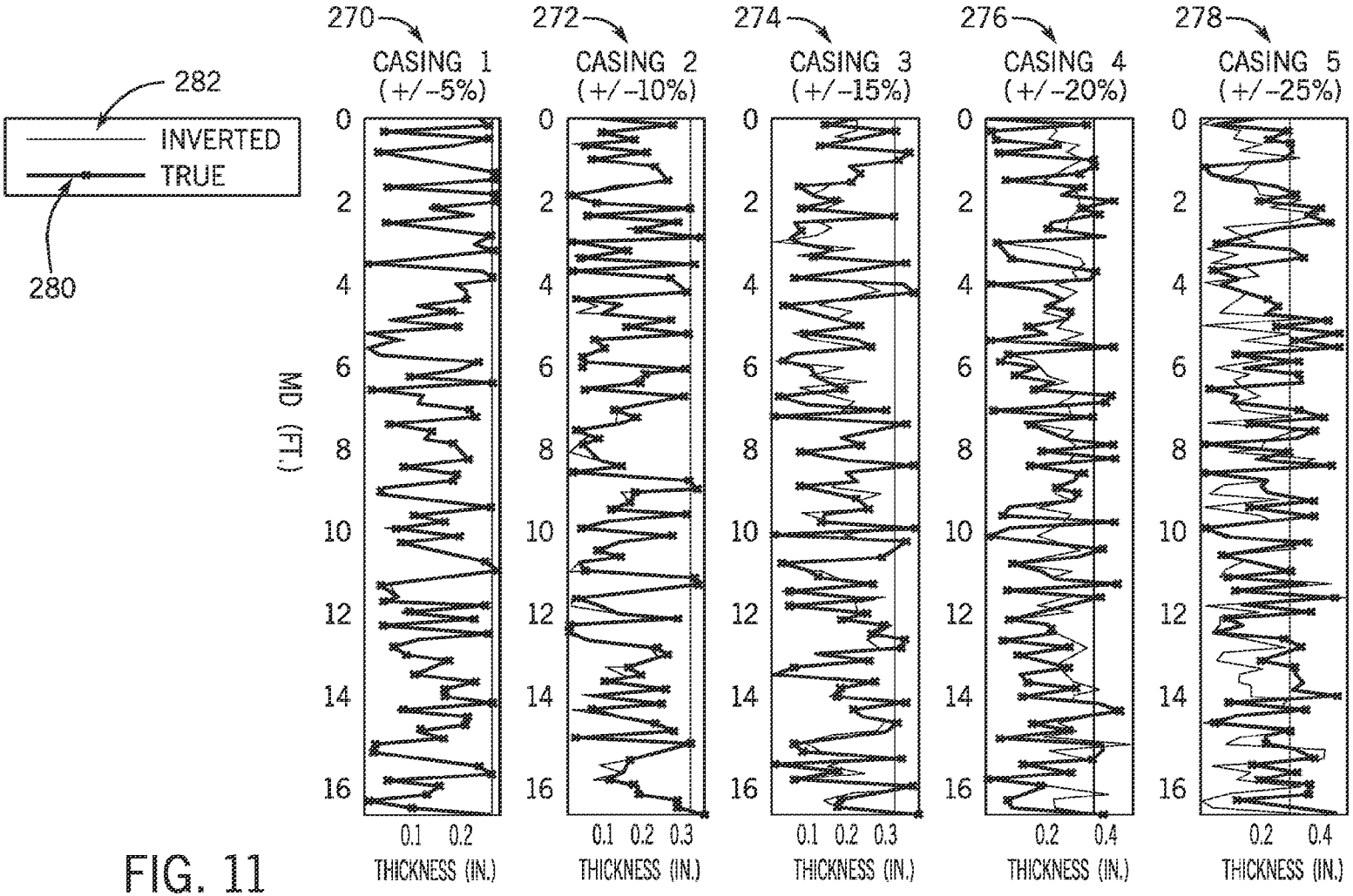
FIG. 11 depicts example processing results for five casings for collocated time-domain measurements, in accordance with embodiments of the present disclosure.

In a second example where five casings are used in the multi-casing evaluations, a five-casing processing is applied to the synthetic data described above. Corresponding five-casing processing results are presented in FIG. 11, which depicts example processing results for five casings 270, 272, 274, 276, and 278 for collocated time-domain measurements corresponding to sensor M (12 inches long) and sensor D (25 inches long). An inverted casing thickness curve 282 corresponding to sensor D primarily match with a curve 280 corresponding to the sensor M and representing a true casing thickness for each casing. The processing results based on synthetic data shows that robust and reliable first three casing results are obtained whereas the ambiguity in the fourth and fifth casings have certain levels of over- or under-estimations. For example, the estimations of losses in the fifth casing have a +/−25% error margin, the estimations of losses in the fifth casing have a +/−20% error margin, whereas the estimations of losses in the third casing have a smaller +/−15% error margin.

Figure 12:
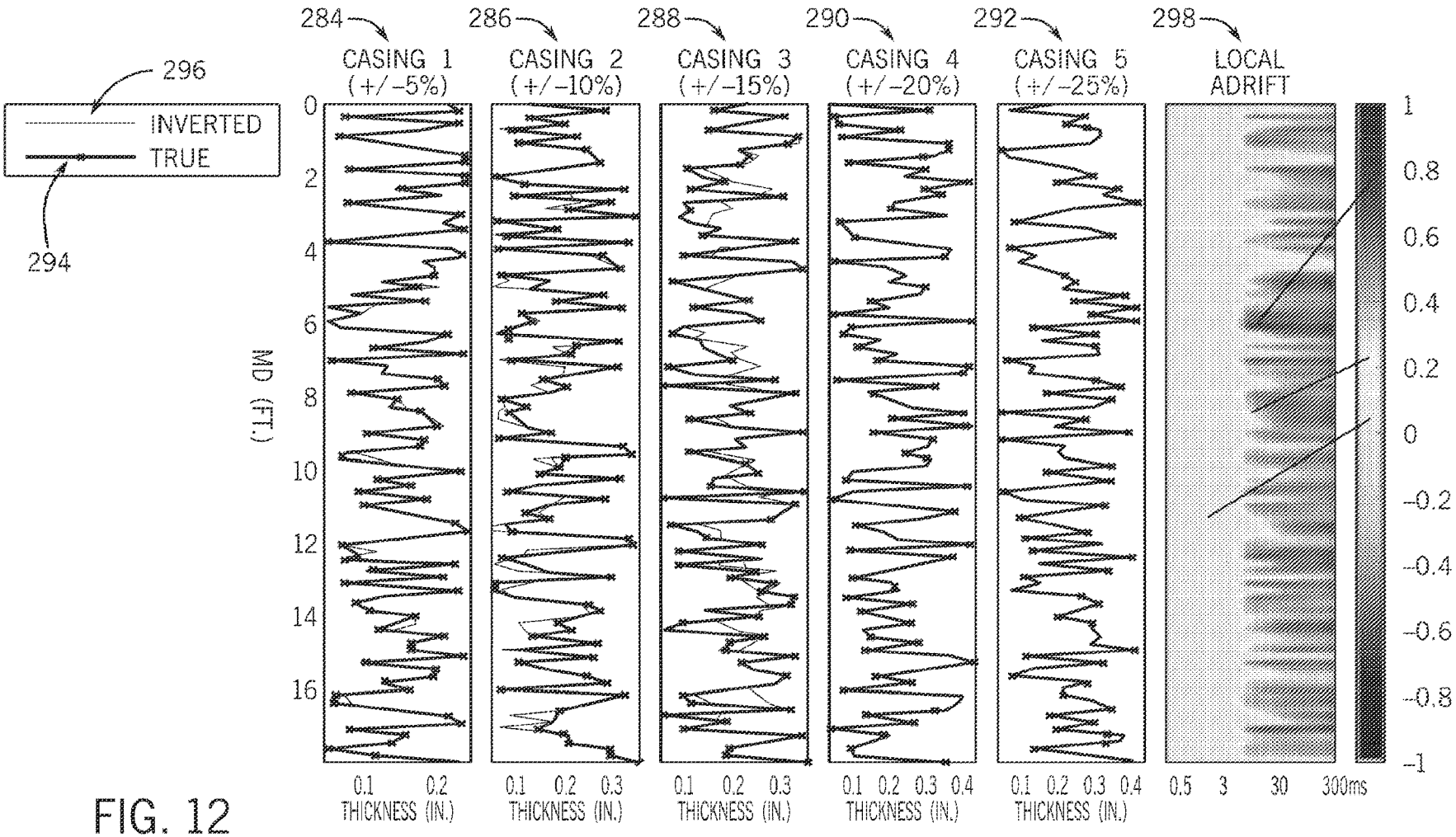
FIG. 12 depicts example results using a 12 inch long collocated sensor for inverting first three-casing thicknesses inside a five-casing completion, in accordance with embodiments of the present disclosure.

FIG. 12 depicts example results using a 12 inch long collocated sensor for inverting first three-casing (casings thicknesses inside a 5-casings completion). Thicknesses of casings 284, 286, and 288 are inverted and corresponding inverted thicknesses are shown using a curve 282 for each individual casing and compared to a curve 280 representing true values for each casing. Thicknesses of outer casings, such as casings 290 and 292 are not inverted. A map 298 representing the local drift (Adrift, which may include positive or negative values) is also presented. In the present example, all Adrift values are positive. The Adrift values at three example points are indicated by three lines, each having one end pointing to an example point on the map 298 and another end pointing to (approximately) a corresponding value in an Adrift value bar with a displaying range of (1, 0, −1).

In certain embodiments, in addition to stand-alone time-domain collocated sensor data processing, the processing results may be further improved by exploiting complementary sensitivities offered by the non-collocated multi-spacing and multi-frequency measurements as discussed below.

For example, inversion-based workflows for time-domain collocated data and multi-frequency non-collocated data processing, such as complementary collocated, non-collocated data processing workflows, may be used in tandem to exploit complementary sensitivities of different measurements. An example of such workflows may include following operations:

a. Invert time-domain collocated sensor data for first k casings (k<=N, depending on sensitivity, typically k=3) based on N-casing model (e.g. see FIG. 12 where 12 inch collocated data is inverted for first three pipe thicknesses);
b. Depth-match collocated sensor results with non-collocated sensor as reference (using first casing collars);
c. Invert multi-frequency non-collocated data for outer casing thicknesses (fix first or first & second from collocated and use the remaining as initial guess);
d. Invert multi-frequency non-collocated data for all collar zones using operation c. results as initial guess; and
e. Iteratively repeat collocated, non-collocated processing until convergence.

Figure 13:
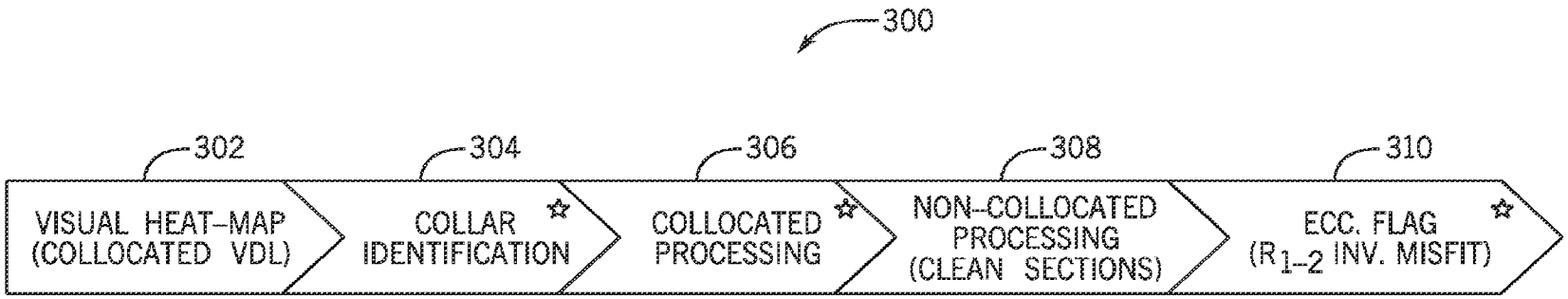
FIG. 13 depicts an example method for combining time-domain collocated data processing and multi-frequency non-collocated data processing, in accordance with embodiments of the present disclosure.

With the foregoing in mind, FIG. 13 depicts an example method 300 for combining time-domain collocated data processing and multi-frequency non-collocated data processing. For example, a data processing system (e.g., the data processing system 38) may receive (e.g., from another data processing system) or generate a visual heat map (e.g., from normalized magnetic field measurement data) to give qualitative time-to-depth visualization (block 302). The visual heat map may be used to identify collar sections, such as collar casings in time-domain collocated data (block 304). In some embodiments, the time-domain collocated data may be first inverted using a collocated processing (block 306). The processed data (e.g., inverted thicknesses, identified collar sections) may be used as input to a multi-frequency non-collocated data processing (block 308). The multi-frequency non-collocated data processing may be adapted to process inverted thicknesses and collar identification results from collocated processing and invert remaining thicknesses (e.g., user-specified) up to 5 or 6 casings. Output data generated by the combined collocated (time domain) and non-collocated (multi-frequency) data processing may be used for further processing or interpretations, such as ECC flagging (block 310).

Figure 14:
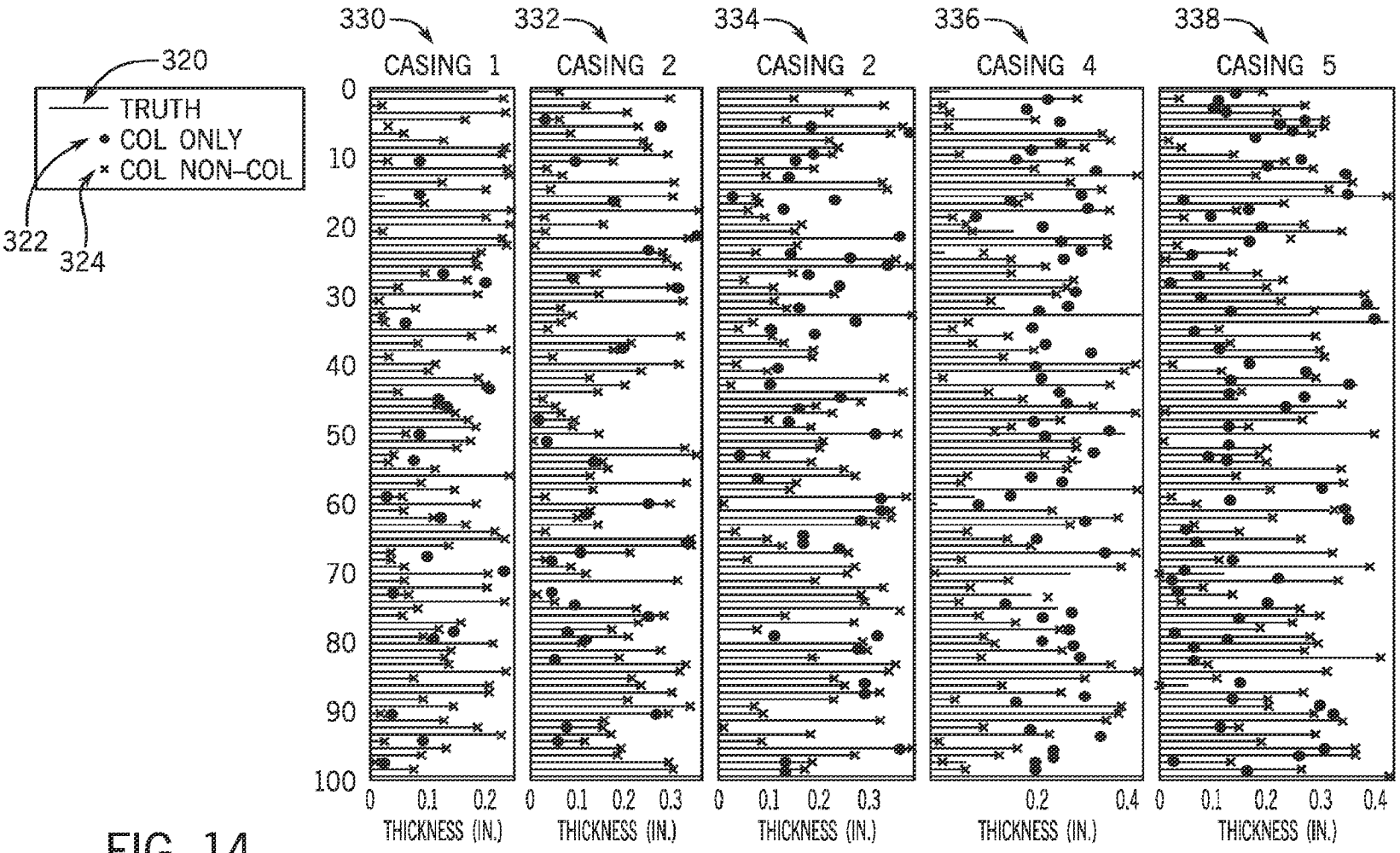
FIG. 14 depicts a reconstruction of five-casing thicknesses using combined collocated (time domain) and non-collocated (multi-frequency) data processing compared with results using collocated processing only, in accordance with embodiments of the present disclosure.

FIG. 14 depicts a reconstruction of five-casing thicknesses using combined collocated (time domain) and non-collocated (multi-frequency) data processing as described above and compared with results using collocated data processing only. In this illustrated example, sensor M with 12 inches length and sensor D with 25 inches length are used for measurements. A curve 320 represents true thickness for each casing, a curve 322 represents inverted casing thickness using collocated data processing only (which include the same data as the inverted casing thickness curve 282 in FIG. 11), and a curve 324 represents inverted casing thickness using combined collocated data processing and non-collocated data processing. Five casings 330, 332, 334, 336, and 338 are used in the illustrated example. The results show that for each casing, the curve 324 representing inverted casing thickness using combined collocated and non-collocated data processing primarily match with the curve 320 representing true thickness. The results also show that the curve 324 has better matches with the curve 320 than the curve 322 representing inverted casing thickness using collocated data processing only.

Figure 15:
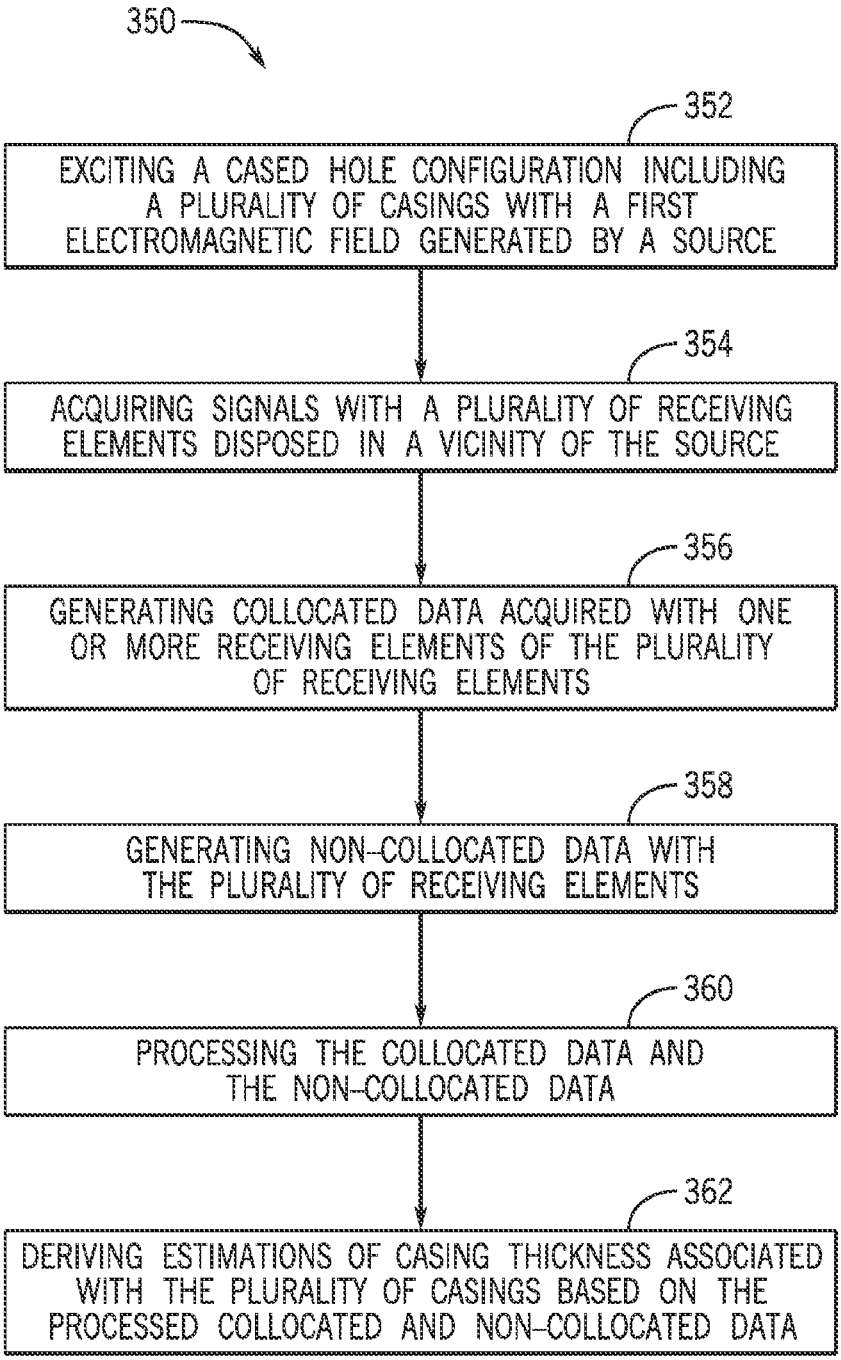
FIG. 15 depicts a flow diagram of a method for determining well casing integrity, in accordance with embodiments of the present disclosure.

FIG. 15 depicts a flow diagram of a method 350 for determining well casing integrity, as described in greater detail herein. In certain embodiments, the method 350 may include exciting a cased hole configuration including a plurality of casings with a first electromagnetic field generated by a source (block 352). The first electromagnetic field may excite a first series of currents (e.g., eddy currents) in the plurality of casings. The first series of currents may decay with time and the decayed first series of currents excite a second electromagnetic field. The second electromagnetic field may excite a second series of currents in the plurality of casings. In addition, in certain embodiments, the method 350 may also include acquiring signals with a plurality of receiving elements disposed in a vicinity of the source (block 354). The acquired signals correspond to the second series of currents. In addition, in certain embodiments, the method 350 may also include generating collocated data acquired with one or more receiving elements of the plurality of receiving elements (block 356). In addition, in certain embodiments, the method 350 may also include generating non-collocated data acquired with the plurality of receiving elements (block 358). In addition, in certain embodiments, the method 350 may also include processing the collocated data and the non-collocated data (block 360). In addition, in certain embodiments, the method 350 may also include deriving estimations of casing thickness associated with the plurality of casings based on the processed collocated data and the processed non-collocated data (block 362).

A model-based inversion workflow is proposed to determine individual casing thickness of up to 5 or even 6 pipes by using both time-domain collocated and multi-frequency non-collocated (multi-spacing) measurements. It is assumed that induction multi-spacing and multi-frequency measurements (attenuation and phase) are available, but the methodology can be applied to only time-domain collocated data as well.

Besides the individual casing profile nonlinear inversion data processing, the inversion-based processing workflows may include inversion based measurement calibration to determine pipe property, novel heat map generation, collar identification from time-domain data. Certain workflow may also provide uncertainties in evaluated casing thicknesses from the model covariance matrix and indicator of casing eccentricity using the misfit of short spacing non-collocated sensor channels.

The methods of the present disclosure may include assumptions, such that the casings are concentric, and the time- and frequency-domain (axisymmetric) forward model ran in the inversion loop includes the tool details (e.g., magnetic core and non-uniform mandrel profile).

The inversion-based processing workflows described herein may provide flexible parameterization options and may determine simultaneously or separately any subset of parameters with corresponding assumptions, such as effective thickness of each casing (assuming the defect is on either inner, outer or both surfaces), magnetic (effective) permeability of each casing (assuming the permeability is the same or different for all casings), and electrical (effective) conductivity of each casing (assuming the conductivity is the same or different for all casing).

The inversion-based processing workflows described herein may include algorithms that may allow inverting for radius of inner and outer surface instead of thickness. Such algorithms may be used in cases that combine EMIT induction type measurements with high resolution measurements (e.g., ultrasonic or lux leakage measurements) to estimate very accurately position of the inner radii or constrain the problem. The inversion-based processing workflows described herein may also be extended to incorporate estimation of pipe eccentricity as an inversion parameter or in the model and utilizing tabulated responses from 3D finite-element (FE) modeling.

The following description will be presented as further information relating to the techniques described herein. In general, inversion minimizes the cost function in terms of difference between the modeled tool response and the actual measurements, sometimes referred as the error term, through adjusting the model, defined by individual casing geometry and properties. The cost function may need to be augmented with an additional regularization term. The balance between the error and the pixel regularization may typically be determined heuristically or managed by adaptive regularization methods. The cost function error term is a difference between the modeled tool response s(x) of the unknown model (centered or decentered casings) parameters x and the actual measurements m.

For time-domain collocated measurements, pre-computed response tables from time-domain 3D FEM solver (NG-Solve) may be used in the inversion loop and for non-collocated sensors tables from axi-symmetric time-harmonic EM solver (CWNLAT). For the error function e(x)=|s(x)−m|, a cost function may be defined in a least squares sense as:

$$C(x) = \frac{1}{2}\|W \cdot e(x)\|^2 + \frac{1}{2}\lambda\|W_x \cdot (x - x_{ref})\|^2,$$

where: W: data weighting matrix, typically as close as possible to the expected standard deviation of corresponding measurement channels Wd=diag(1/σi). Wx: parameter weighting matrix of regularization term λ: regularization constant. The model parameters x are obtained by minimization of the cost function:

$$x^* \min_x [C(x)].$$

Box constraints may be used to bound model parameters x (xmin≤x≤xmax). For a given parameter set x the cost function may be linearized, $$e(x + p) \approx e(x) + J(x) \cdot p$$

where J(x) is the Jacobian matrix that contains the first derivatives of the simulated response, $$(J(x))_{ij} = \frac{\partial e_i}{\partial x_j}(x) = \frac{\partial s_i}{\partial x_j}(x),$$

and the step p that decreases the cost function may be determined iteratively until convergence. The linearized error term may be inserted in the cost function and the linearized cost function may be:

$$C(x + p) \approx L(p) = C(x) + g(x) \cdot p + \frac{1}{2}p^T \cdot H(x) \cdot p$$

with the gradient g(x)=JT·WT·W·e(x)+λWxT·Wx·(x−xref) and the Hessian matrix H(x)=JT·WT·W·J+λWxT·Wx. The regularization term may be added to the cost function to bias the solution towards xref. It may be chosen as the previous step value in order to penalize large changes in parameter values. The regularization constant λ is proportional to squared error term λ=λinput W·e(x)2, this decreases the bias of inversion with progression towards global minimum.

If a Huber inversion is used (robust to data outliers and noise), the data error term of the cost function changes to:

$$\chi^2 = \sum_i w_i \cdot \varphi(e_i(x))$$

with the Huber function $$\varphi(y) = \begin{cases} y^2 & |y| < \delta \\ 2\delta(|y| - 0.5\delta) & |y| > \delta \end{cases}$$

where function y corresponds to data error (difference between measurement and model) and δ is the threshold where the error calculation switches from squared to linear.

Model Parameterization

The inversion can resolve any subset of following parameters:

a. casing thickness (thi) of each section;
b. bounds of intervals for each casing defining constant thickness;
c. center (ci) of each casing;
d. permeability (μi) of individual casings or assume all the casings have the same properties; and
e. conductivity (σi) of individual casings or assume all the casings have the same properties.

The standard setting is that metal loss on inside and outside is the identical.

The inversion model parameterization also allows inverting for the inner and/or outer diameter of individual casings. This functionality is useful in a case where sufficient information content in the data to resolve these parameters is available, or if some is known from some other data, such as ultrasonic measurements.

In some interpretations, it may be assumed that the measured data comes from centered casings or has been corrected to remove eccentering effects. A typical use of inversion in the workflow is as follows:

a. For measurement calibration: invert for the casing magnetic permeabilities and/or electric conductivities for a known set of casing thicknesses. Nominal casing thickness at multiple measured depths may be assumed, inverting for casing properties and eccentering;
b. Process calibrated data for casing thicknesses, using known determined permeability and conductivity from the calibration step. The processing can be parallel or sequential;
c. Refined inversion interpretation in combination with other data, such as ultrasonic or flux leakage data, that can be used to constrain some parameters (e.g., first casing inner or outer diameter for ultrasonic/flux leakage and maybe eccentering);
d. The inversion also outputs: data misfit, residual, model covariance and data resolution matrix, can be used for interpretation QC use:
i. Eccentering indicator from quality of fit of short spacing non-collocated, in case long spacing data are well reconstructed and un-expected metal gain indicated by collocated sensors in the pipe-sections;
ii. Estimate the parameter uncertainty from the model covariance matrix; and
iii. Use data resolution matrix to evaluate the information content in the data—can be used for optimal selection of measurements in the job planner.

Post-Processing Inversion Results

A data resolution matrix may be defined in terms of sensitivities (Jacobian matrix, J) and it may include the data weight and the regularization terms used in the inversion, $$\hat{m} = R^{data} \cdot m^{obs} = J\left[J^T W^T W J + \lambda W_x^T W_x\right]^{-1} J^T W^T W \cdot m^{obs}.$$

The symmetrized version of $R_{data}$ may be used to analyze off-diagonal elements of Rdata and the dependence of one reconstructed data point on all the other data points, $$R_{sym}^{data} = WJ\left[J^T W^T W J + \lambda W_x^T W_x\right]^{-1} J^T W^T.$$

The uncertainty in the inverted parameters can be expressed in the form of the Hessian matrix, H=[JTWTWJ+λWx TWx]. Since this matrix comes as a byproduct of the inversion scheme and the data error term $\chi^2$ is evaluated, the mathematical uncertainty (σj) in the jth inverted parameter is given by:

$$\sigma_j = \left(\sqrt{\chi^2 [H^{-1}]_{j,j}}\right.$$

Similarly, correlation of the inverted parameters i and j can be obtained from normalized off-diagonal elements of the inverted Hessian matrix.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. § 112(f). However, for any claims containing elements designated in any other manner, it is intended that such elements are not to be interpreted under 35 U.S.C. § 112(f).

What is claimed is:

1. A method for determining well casing integrity, comprising:

exciting a cased hole configuration comprising a plurality of casings with a first electromagnetic field generated by a source, wherein the first electromagnetic field excites a first series of currents in the plurality of casings, wherein the first series of currents decay with time, wherein the decayed first series of currents excite a second electromagnetic field, and wherein the second electromagnetic field excites a second series of currents in the plurality of casings;

acquiring signals with a first plurality of receiving elements collocated with the source and a second plurality of receiving elements disposed in a vicinity of the source, wherein the acquired signals correspond to the second series of currents;

generating collocated data based on a portion of the signals acquired with the first plurality of receiving elements;

generating non-collocated data based on a different portion of the signals acquired with the second plurality of receiving elements;

processing the collocated data and the non-collocated data using combined collocated and non-collocated processing; and deriving estimations of casing thickness associated with the plurality of casings based at least in part on the processed collocated data and the processed non-collocated data, wherein the plurality of casings comprises at least 5 casings.

2. The method of claim 1, wherein the estimations of casing thickness comprise casing thickness variations induced by casing corrosions, casing wear, a plurality of collars, or a combination thereof.

3. The method of claim 1, wherein the source comprises a transmitter, wherein the transmitter comprises a transmitter coil.

4. The method of claim 3, wherein the transmitter coil comprises a solenoidal coil.

5. The method of claim 4, wherein each receiving element comprises a receiver coil.

6. The method of claim 5, wherein the receiver coil is wound on the same core as the transmitter coil.

7. The method of claim 1, wherein the collocated data comprises time domain collocated data comprising changes in phase or signal strength induced by casing thickness variations.

8. The method of claim 1, wherein the non-collocated data comprises multi-frequency, multi-spacing data comprising changes in phase or signal strength induced by casing thickness variations.

9. The method of claim 1, wherein deriving the estimations of the casing thickness comprises inverting a casing thickness in a multi-pass, multi-step workflow using time-windowed data for each casing of the plurality of casings, wherein the time-windowed data is generated by applying automatic adaptive window selections in the collocated data.

10. The method of claim 9, wherein the multi-pass, multi-step workflow comprises median filtering.

11. The method of claim 9, wherein the multi-pass, multi-step workflow comprises three-pass.

12. A method for determining well casing integrity, comprising:

exciting a cased hole configuration comprising a plurality of casings and a plurality of collars with a first electromagnetic field generated by a source, wherein the first electromagnetic field excites a first series of currents in the plurality of casings, wherein the first series of currents decay with time, wherein the decayed first series of currents excite a second electromagnetic field, and wherein the second electromagnetic field excites a second series of currents in the plurality of casings;

acquiring signals with a first plurality of receiving elements collocated with the source and a second plurality of receiving elements disposed in a vicinity of the source, wherein the acquired signals correspond to the second series of currents;

generating collocated data based on a portion of the signals acquired with the first plurality of receiving elements;

generating non-collocated data based on a different portion of the signals acquired with the second plurality of receiving elements;

processing the collocated data and the non-collocated data using combined collocated and non-collocated processing; and deriving the estimations of casing thickness in a plurality of collar casing sections associated with the plurality of collars and the plurality of casings based at least in part on the processed collocated data and the processed non-collocated data, wherein the plurality of casings in the plurality of collar casing sections comprise at least 5 casings.

13. The method of claim 12, wherein the estimations of casing thickness comprise casing thickness variations induced by casing corrosions, casing wear, the plurality of collars, or a combination thereof.

14. The method of claim 12, wherein the collocated data comprises time domain collocated data comprising changes in phase or signal strength induced by casing thickness variations.

15. The method of claim 12, wherein the estimations of casing thickness comprise inverting a casing thickness in a multi-pass, multi-step workflow using time-windowed data for each casing of the plurality of casings, wherein the time-windowed data is generated by applying automatic adaptive window selections in the collocated data.

16. The method of claim 15, wherein the estimations of casing thickness comprise correcting raw receiving element responses using calibrated receiving element responses for long sections of casing corrosions.

17. The method of claim 12, wherein deriving the estimations of casing thickness in the plurality of collar casing sections comprises using a collar identification algorithm in processing the collocated data.

18. The method of claim 15, wherein deriving the estimations of casing thickness in the plurality of collar casing sections comprises isolating and processing the collar casing sections differently than the non-collar casing sections.

19. A system, comprising:

a downhole electromagnetic tool, comprising:

one or more electromagnetic sources to generate a first series of electrical currents in a plurality of tubulars disposed in a vicinity of the one or more electromagnetic sources;

one or more collocated receivers collocated with the one or more electromagnetic sources and one or more non-collocated receivers located in a vicinity of the one or more electromagnetic sources to measure individual or cumulative thicknesses of the tubulars based at least in part on a second series of electrical currents generated by an electromagnetic field excited by the first series of electrical currents being decayed with time, wherein the downhole electromagnetic tool is configured to:

generate collocated data based on collocated measurements from the one or more collocated receivers; and generate non-collocated data based on non-collocated measurements from the one or more non-collocated receivers; and processing circuitry to process measured individual or cumulative thicknesses of the tubulars based on a combined collocated data and non-collocated data processing, wherein the plurality of tubulars comprises at least 5 tubulars.

20. The system of claim 19, wherein a source-receiver spacing is longer than approximately 2.5 times an outer diameter of the tubulars being measured.

* * * * *